US011572691B1

(12) United States Patent
Newton et al.

(10) Patent No.: US 11,572,691 B1
(45) Date of Patent: Feb. 7, 2023

(54) MODULAR WALL SYSTEM

(71) Applicant: Newton Design, LLC, Catoosa, OK (US)

(72) Inventors: Jeffrey Newton, Broken Arrow, OK (US); Kelly Greenleaf, Broken Arrow, OK (US)

(73) Assignee: Newton Design, LLC, Catoosa, OK (US)

( * ) Notice: Subject to any disclaimer, the term of this patent is extended or adjusted under 35 U.S.C. 154(b) by 0 days.

(21) Appl. No.: 17/079,719

(22) Filed: Oct. 26, 2020

Related U.S. Application Data

(60) Provisional application No. 62/925,841, filed on Oct. 25, 2019.

(51) Int. Cl.
*E04B 2/74* (2006.01)
*E04B 2/00* (2006.01)
*E04C 2/34* (2006.01)

(52) U.S. Cl.
CPC ..... *E04B 2/7405* (2013.01); *E04C 2/34* (2013.01); *E04C 2/46* (2013.01); *E04C 2002/3488* (2013.01)

(58) Field of Classification Search
CPC . E04B 2/7405; E04C 2/34; E04C 2/46; E04C 2002/3488
USPC ..... 52/582.1
See application file for complete search history.

(56) References Cited

U.S. PATENT DOCUMENTS 3,017,969 A * 1/1962 Nielsen ..... F16B 5/0685 52/270
3,500,597 A * 3/1970 McKenzie ..... E04B 1/10 52/92.1
3,608,258 A * 9/1971 Spratt ..... E04B 2/7448 52/241
3,623,288 A * 11/1971 Horowitz ..... E04B 1/10 52/264
4,118,903 A * 10/1978 Coulthard ..... F16B 5/0607 160/351
4,185,430 A * 1/1980 Gartung ..... E04B 2/7425 52/287.1
4,395,856 A * 8/1983 Smith ..... E04B 2/7438 160/135
4,478,018 A * 10/1984 Holand ..... E04B 1/762 52/220.1
4,595,105 A * 6/1986 Gold ..... A47B 47/00 211/184
4,949,519 A * 8/1990 Jeffers ..... E04B 2/7416 52/239

(Continued)

FOREIGN PATENT DOCUMENTS

GB 2534197 A * 7/2016 ..... F41H 5/24
IT 1225117 B * 11/1990 ..... E06B 1/603
KR 101045432 B1 * 6/2011 ..... E04H 9/10

*Primary Examiner* — Brian D Mattei
*Assistant Examiner* — Joseph J. Sadlon
(74) *Attorney, Agent, or Firm* — Head, Johnson, Kachigian & Wilkinson, PC

(57) ABSTRACT

A lightweight, interlocking, freestanding, reconfigurable, all-weather wall system for use in law enforcement, emergency services, and military training. The wall system may comprise a plurality of wall panels and a plurality of panel interlocking connectors capable of temporarily connecting two or more wall panels. The modular wall system may be capable of being assembled and disassembled without the use of tools.

14 Claims, 46 Drawing Sheets

(56) References Cited

U.S. PATENT DOCUMENTS 5,219,316 A * 6/1993 Huffman ..... F41J 11/00 472/62
5,347,778 A * 9/1994 Bray ..... E04B 2/7425 160/135
5,560,413 A * 10/1996 Brown ..... E04B 2/7425 403/403
5,588,274 A * 12/1996 Lange ..... F16B 5/004 24/20 R
5,640,816 A * 6/1997 Reiland ..... E04B 1/6116 52/239
5,816,003 A * 10/1998 Larsson ..... F16B 7/0473 52/656.1
5,992,110 A * 11/1999 Clear ..... E04B 1/6162 52/271
6,112,472 A * 9/2000 Van Dyk ..... A47B 83/001 52/239
6,115,977 A * 9/2000 Hornberger ..... A47B 95/008 52/238.1
6,298,619 B1 * 10/2001 Davie ..... E04B 1/14 52/220.7
6,415,567 B1 * 7/2002 Mead ..... E04B 2/7422 160/135
6,786,017 B2 * 9/2004 Thompson ..... E04B 2/7433 52/298
7,159,365 B2 * 1/2007 Cohen ..... E04B 2/7457 52/108
7,159,503 B1 * 1/2007 Weatherwax ..... F41H 5/24 86/50
7,246,471 B2 * 7/2007 Riermann ..... F41H 5/0457 52/282.4
7,621,209 B2 * 11/2009 Bateman ..... F41J 1/00 89/36.02
7,637,073 B2 * 12/2009 Elliott ..... E04B 2/7457 52/745.05
7,707,795 B2 * 5/2010 Yu ..... E04B 2/7422 52/657
7,762,175 B1 * 7/2010 Bhatnagar ..... F41H 5/0457 89/914
7,866,106 B2 * 1/2011 Bowlware ..... F41H 5/24 52/592.1
7,967,296 B1 * 6/2011 Halverson ..... F41J 11/00 273/410
8,161,710 B2 * 4/2012 Elliott ..... F41H 5/02 52/745.05
8,245,466 B2 * 8/2012 Wright ..... E04C 3/07 52/241
9,145,729 B2 * 9/2015 Spransy ..... E04H 9/06
9,157,249 B2 * 10/2015 Segall ..... E04B 1/34384
9,453,711 B2 * 9/2016 Martin ..... F41J 1/10
9,803,959 B2 * 10/2017 Scarinci ..... F41H 5/013
9,952,021 B2 * 4/2018 Ferguson ..... E04H 9/10
10,024,633 B2 * 7/2018 Horch ..... F41J 11/02
10,365,062 B2 * 7/2019 Oesch ..... E04B 1/34315
10,487,499 B1 * 11/2019 Berkowitz ..... E04B 1/34321
11,174,632 B2 * 11/2021 Rosan ..... E04C 2/46
2005/0034378 A1 * 2/2005 Underwood ..... A47B 46/005 52/36.1
2009/0000214 A1 * 1/2009 Stanley ..... E04C 2/34 52/94
2009/0188188 A1 * 7/2009 Rivet ..... E04B 1/10 52/656.1
2010/0293868 A1 * 11/2010 Holzworth ..... F41J 11/00 52/79.5
2011/0099921 A1 * 5/2011 Fitzgerald ..... E04B 2/7425 52/745.13
2012/0073233 A1 * 3/2012 Harrington ..... E04B 2/62 52/745.1
2013/0036952 A1 * 2/2013 Hughes, Jr. ..... E04C 2/3405 109/80
2015/0337883 A1 * 11/2015 Corden ..... F16B 7/042 403/286
2015/0354926 A1 * 12/2015 Gibson ..... F41J 11/00 89/36.04
2016/0332411 A1 * 11/2016 Weissteiner ..... B27M 3/0026
2017/0138045 A1 * 5/2017 Lasry ..... E04B 7/105
2017/0350125 A1 * 12/2017 De Cauwer ..... E04C 2/365
2018/0251222 A1 * 9/2018 Banfield ..... E04B 2/7433 52/298
2018/0258636 A1 * 9/2018 Rahmanian ..... F41J 11/02
2019/0292776 A1 * 9/2019 Maxam ..... E04B 1/28

* cited by examiner

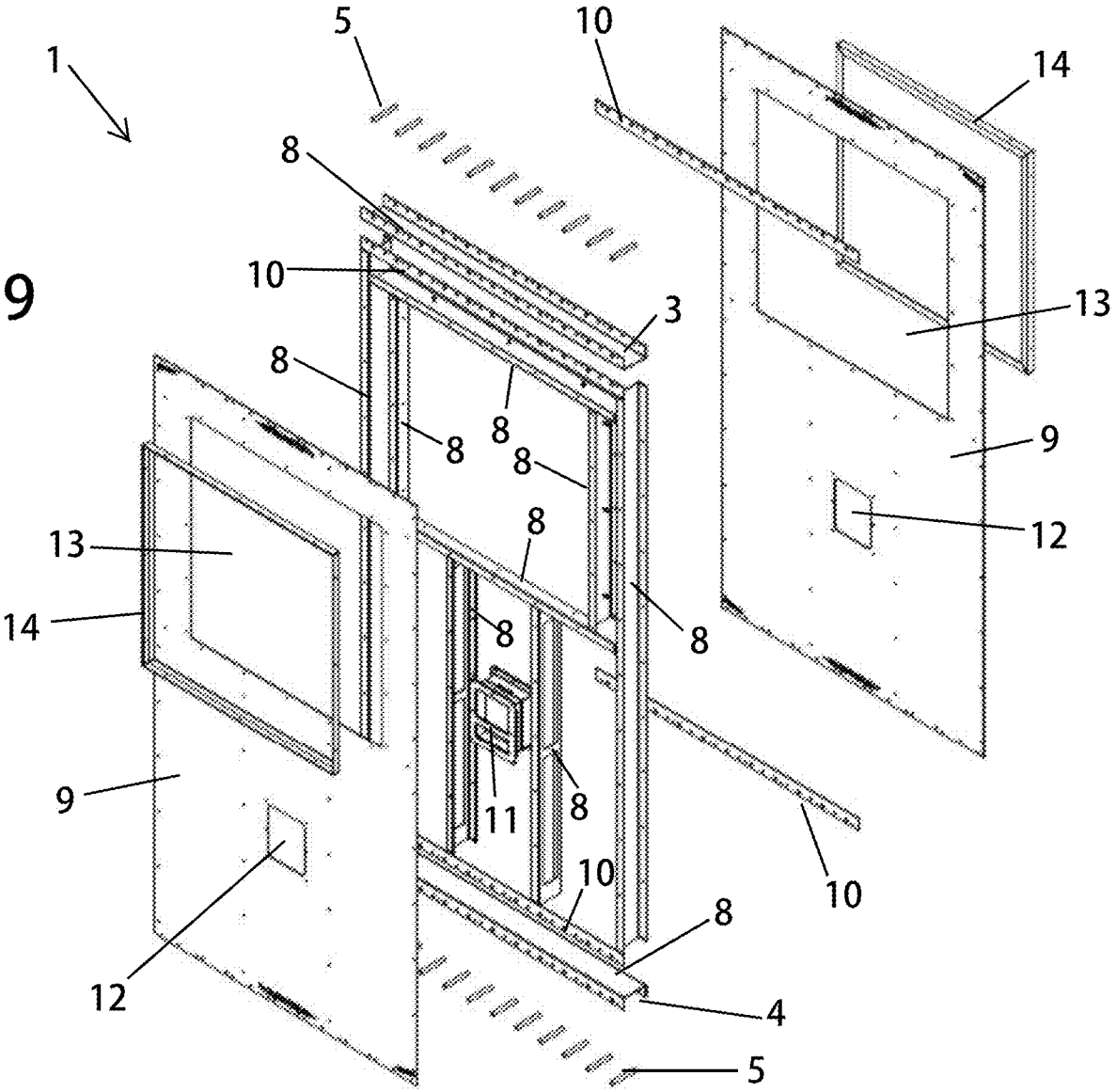
1
5
5
3
4
8
8
8

MODULAR WALL SYSTEM

CROSS REFERENCE

This application is based on and claims priority to U.S. Provisional Patent Application No. 62/925,841 filed Oct. 25, 2019.

BACKGROUND OF THE INVENTION

Field of the Invention

This invention relates generally to a wall system, and more particularly, but not by way of limitation, to a lightweight, interlocking, freestanding, reconfigurable, all-weather wall system for use in law enforcement, emergency services, and military training.

Description of the Related Art

Training is essential for law enforcement, emergency services, and military personnel. It is a common practice to conduct tactical training in the type of environment that such personnel may encounter in the field. This includes training in buildings. Some organizations have permanent structures dedicated to such training. The problem with permanent structures is that their location and configuration are fixed.

There are a number of options for temporary walls that can be erected in a desired location in a desired configuration, then removed or repositioned. The problem with these existing wall systems is that they are difficult and time consuming to assemble and are often heavy and thus difficult to move. Furthermore, many of these existing wall systems have limited options for configuration. Finally, many of the existing wall systems are designed specifically for either indoor or outdoor use, limiting their utility.

There is a particular need among various law enforcement agencies for a wall system that can be quickly assembled to simulate a real-world location to allow a tactical team to practice entering that location prior to actually doing so. Typically, in such a situation, time is of the essence and precision in dimensions of the simulation is vital, increasing the importance of speed and ease of assembly and versatility in configuration of the wall system. The existing wall systems currently on the market are all either too difficult or time consuming to assemble or do not offer sufficient flexibility of configuration to meet the needs of law enforcement.

Based on the foregoing, it is desirable to provide a modular wall system that is lightweight, easy to assemble, and appropriate for both indoor and outdoor use.

It is further desirable for the modular wall system to be easily reconfigurable.

It is further desirable for the modular wall system to be able to be assembled without the use of tools.

It is further desirable for the modular wall system to include small-scale components that may be built into a scale model of desired training environment to allow for planning both of the training environment itself prior to assembly and of the actions of personnel both within the training environment after assembly and within the real-world environment represented thereby.

SUMMARY OF THE INVENTION

In general, in a first aspect, the invention relates to a modular wall system comprising a plurality of wall panels and a plurality of panel interlocking connectors capable of temporarily connecting two or more wall panels. The modular wall system may be capable of being assembled and disassembled without the use of tools.

Each of the wall panels may comprise a top channel, a bottom channel, and a plurality of wall pins, where each of the wall pins spans either the top channel or the bottom channel and each of the wall pins in the top channel are equally spaced apart and each of the wall pins in the bottom channel are equally spaced apart. Each of the panel interlocking connectors may comprise a plate and one or more saddle assemblies, where each of the saddle assemblies is receivable within either the top channel or the bottom channel, each of the saddle assemblies comprising a pair of slots, where the wall pins are receivable within the slots.

The wall panels and panel interlocking connectors may be compatible with non-lethal training ammunition.

The plurality of wall panels may comprise one or more wall panel with a window therein, one or more wall panel with a door therein, one or more wall panel with no door and no window, or any combination thereof. Each wall panel may comprise a plurality of sheet metal channels and two sheet metal skins. Each wall panel may comprise at least one handle structure.

The modular wall system may further comprise a plurality of pins capable of temporarily securing the panel interlocking connectors to the wall panels.

The plurality of panel interlocking connectors may comprise one or more straight panel interlocking connector, one or more cross-shaped panel interlocking connectors, one or more corner panel interlocking connectors, one or more T-shaped panel interlocking connectors, or any combination thereof. The straight panel interlocking connector may be capable of joining two wall panels side-by-side. The cross-shaped panel interlocking connector may be capable of joining three or four wall panels to form a cross shape. The corner panel interlocking connector may be capable of joining two wall panels to form a corner. The T-shaped panel interlocking connector may be capable of joining two or three wall panels to form a T-shape.

The plurality of wall panels may comprise a plurality of full-size wall panel and a plurality of miniature wall panels and the plurality of panel interlocking connectors may comprise a plurality of full-size panel interlocking connectors and a plurality of miniature panel interlocking connectors, such that the system is capable of being configured into both a full-size walled structure and a model of the full-size walled structure.

BRIEF DESCRIPTION OF THE DRAWINGS

FIG. 19 is an exploded perspective view of a wall panel of the modular wall system, where the wall panel has a window;

Figure 1A:
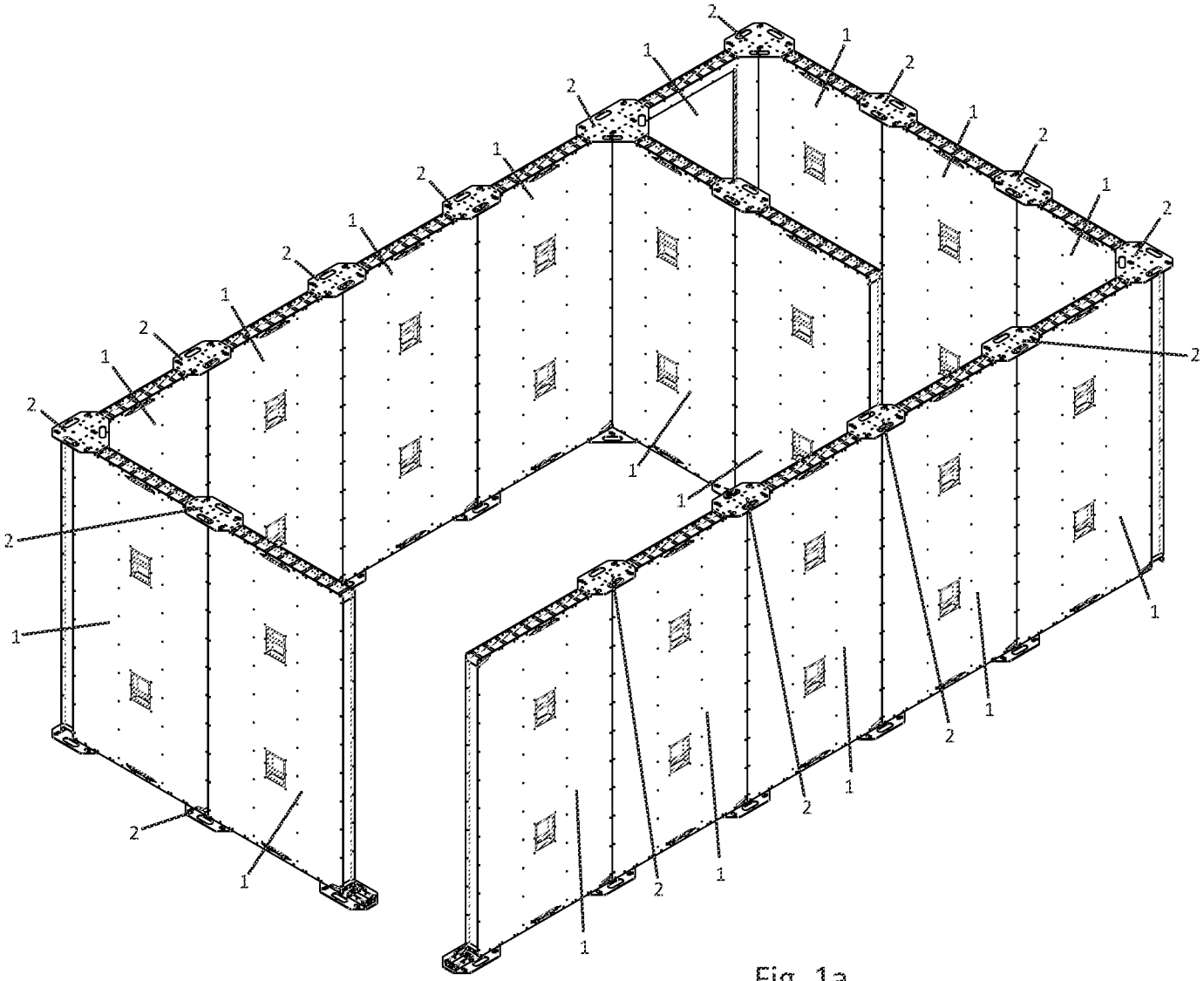
FIG. 1*a* is a perspective view of an assembled configuration of the modular wall system.
Figure 1B:
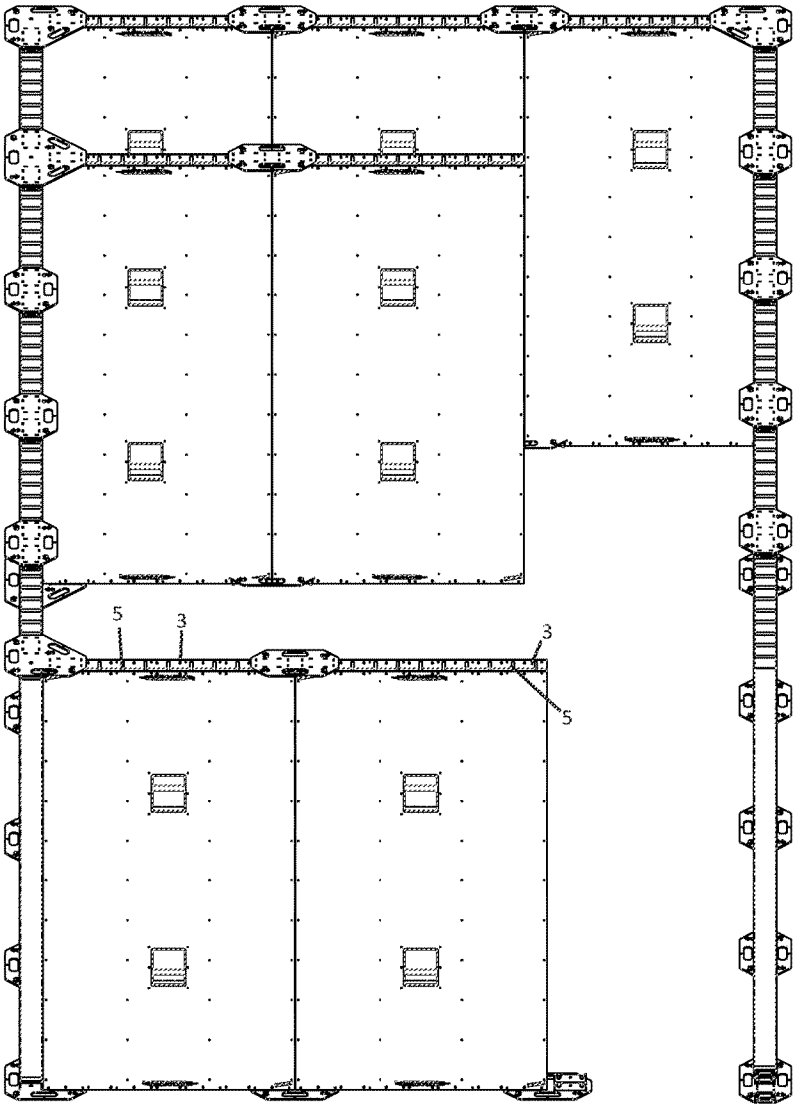
FIG. 1*b* is an alternate angle on the perspective view of the assembled configuration of the modular wall system of FIG. 1*a;*
Figure 2:
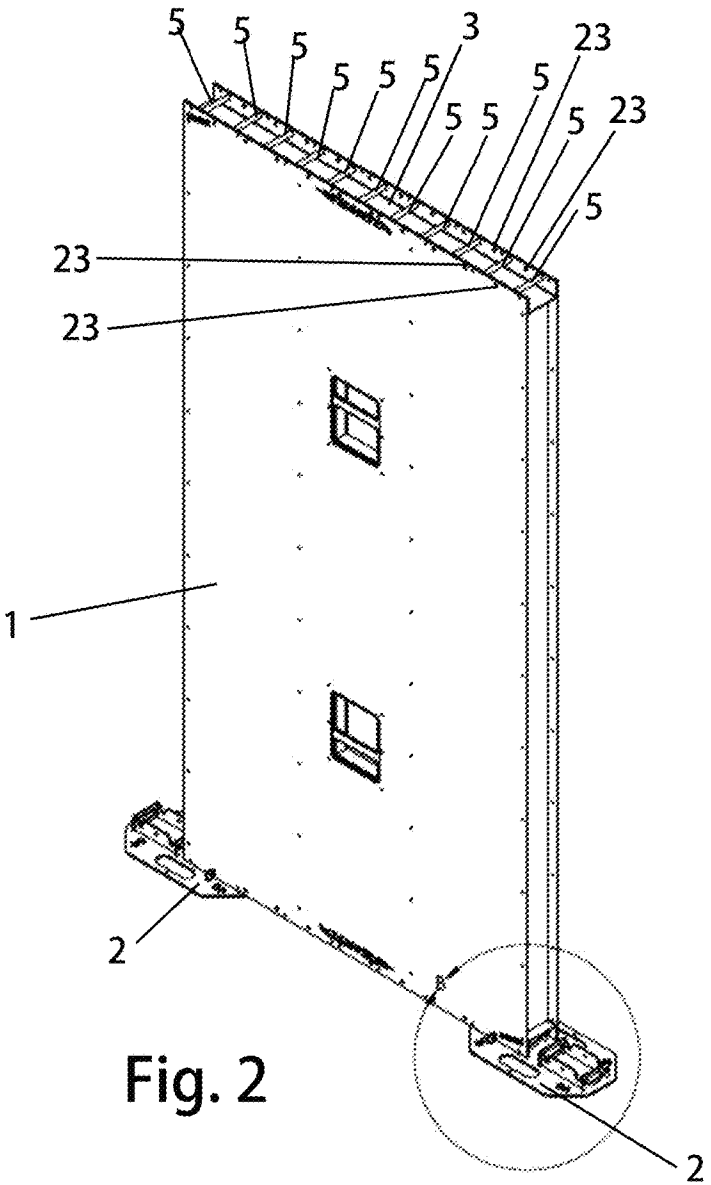
FIG. 2 is a perspective view of a wall panel of the modular wall system with two panel interlocking connectors in place on the bottom thereof.
Figure 3:
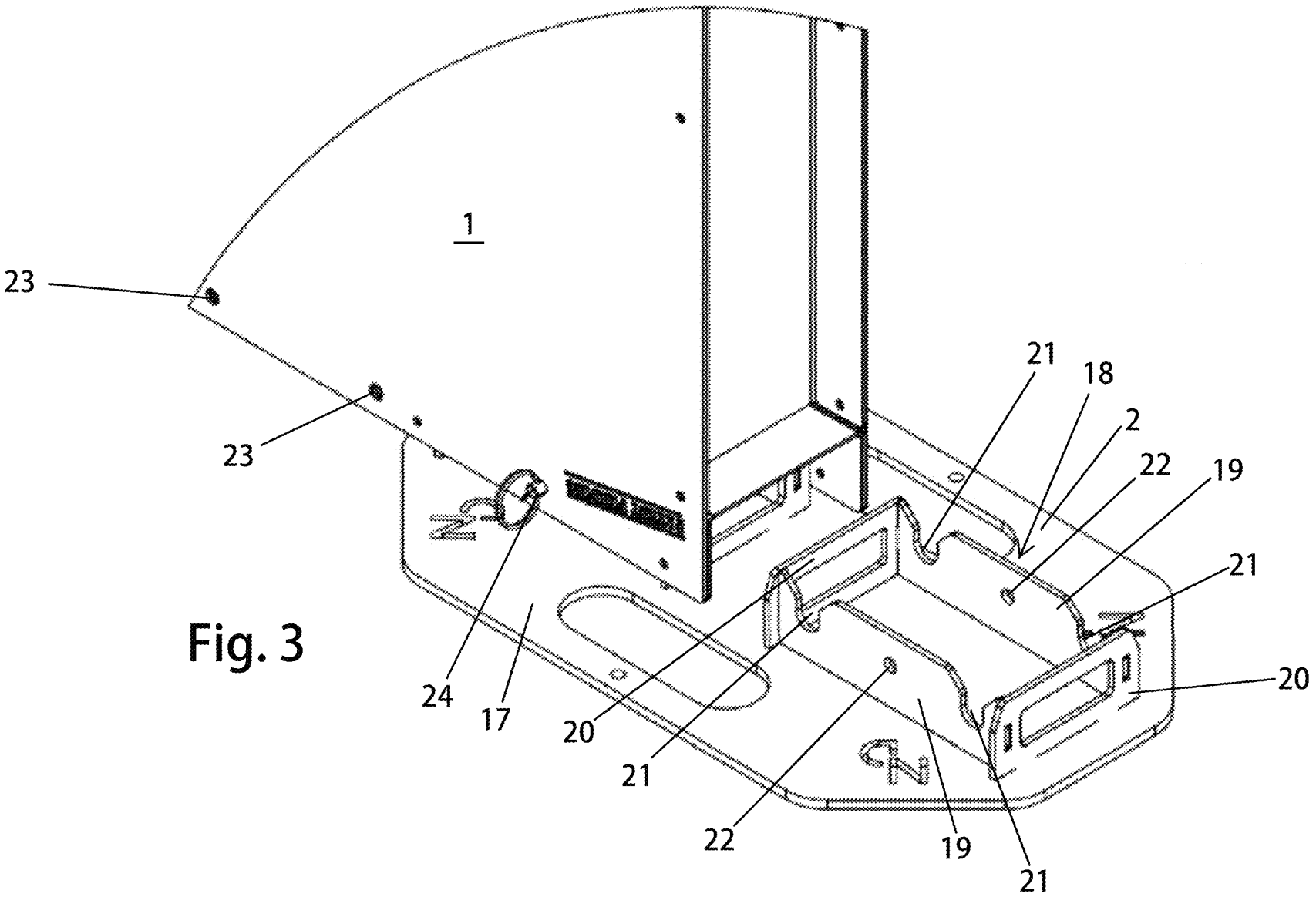
FIG. 3 is a detailed perspective view of a lower corner of the wall panel of FIG. 2, showing the panel interlocking connector in place on the bottom thereof.
Figure 4:
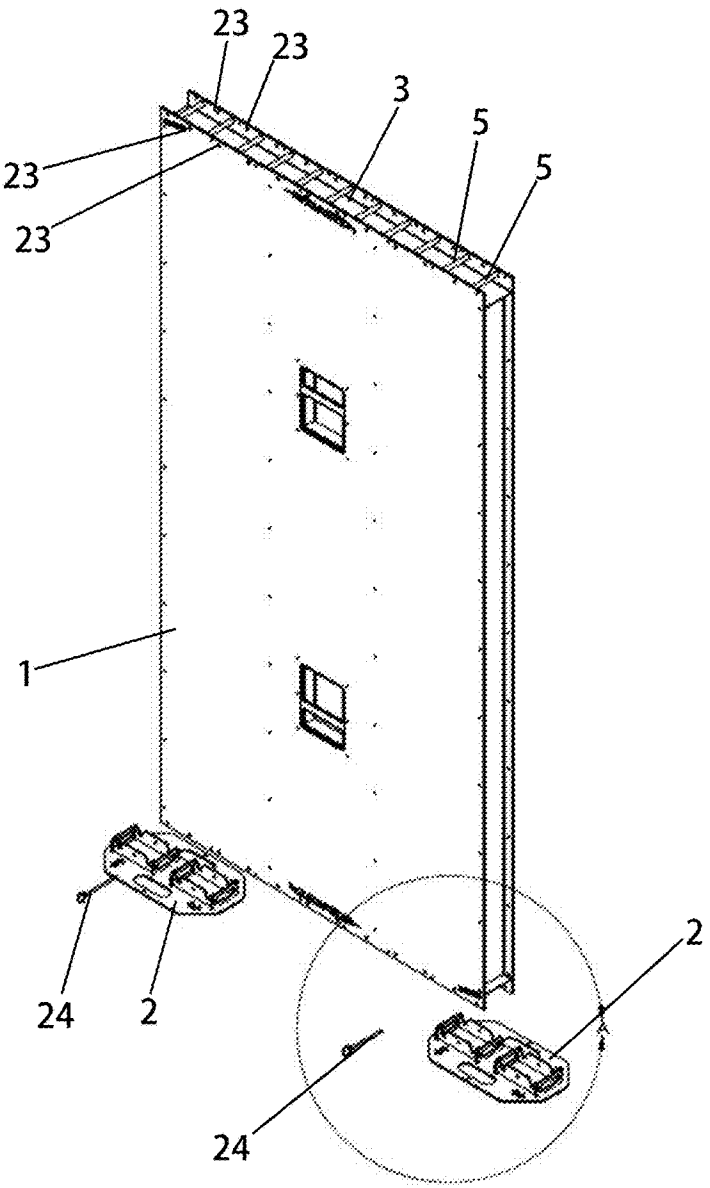
FIG. 4 is an exploded perspective view of the wall panel and two panel interlocking connectors of FIG. 2.
Figure 5:
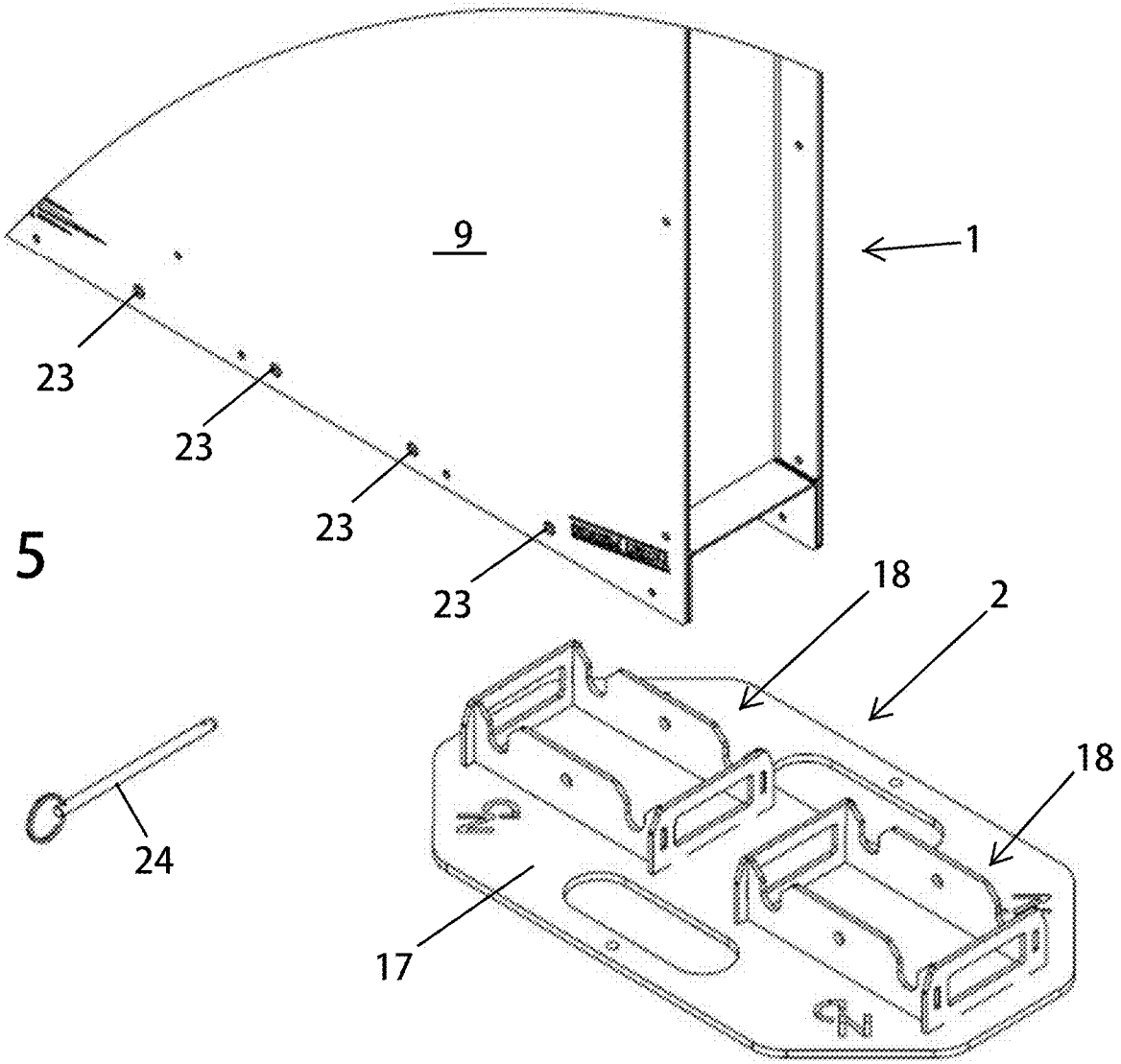
FIG. 5 is a detailed exploded perspective view of a lower corner of the wall panel and one panel interlocking connector of FIG. 2.
Figure 7:
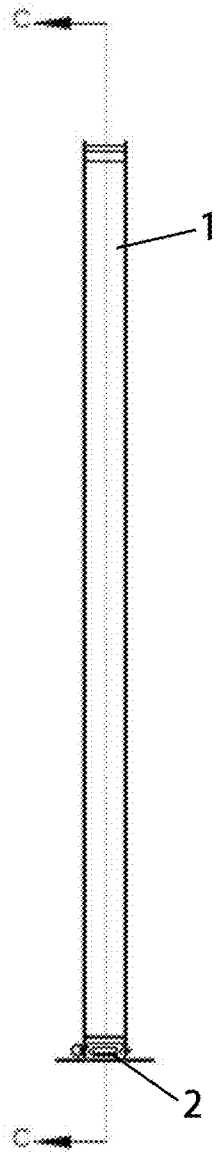
FIG. 7 is a side view thereof.
Figure 6:
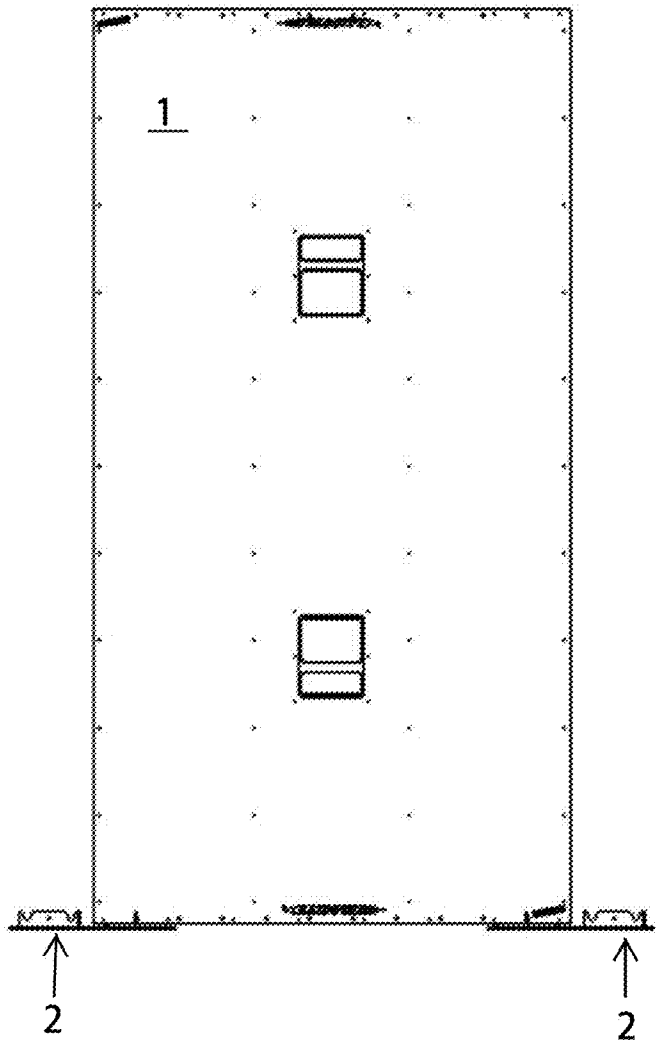
FIG. 6 is a front view the wall panel and two panel interlocking connectors of FIG. 2.
Figure 9:
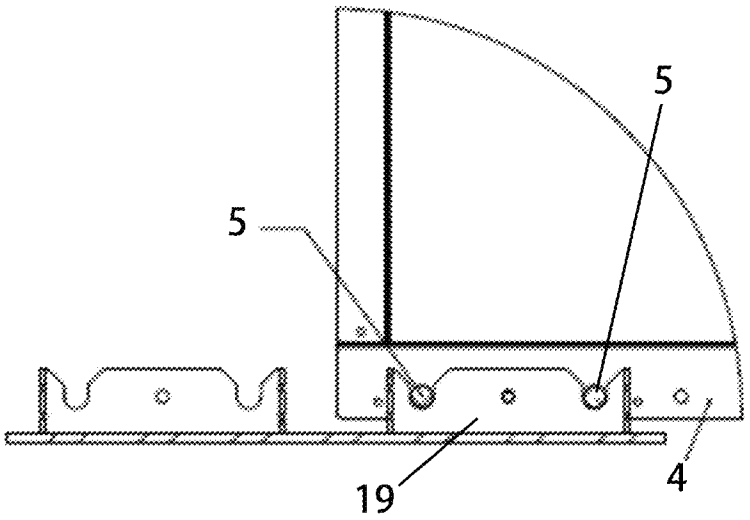
FIG. 9 is a detailed cross-sectional view of a lower corner of the wall panel and interlocking connector of FIG. 8.
Figure 8:
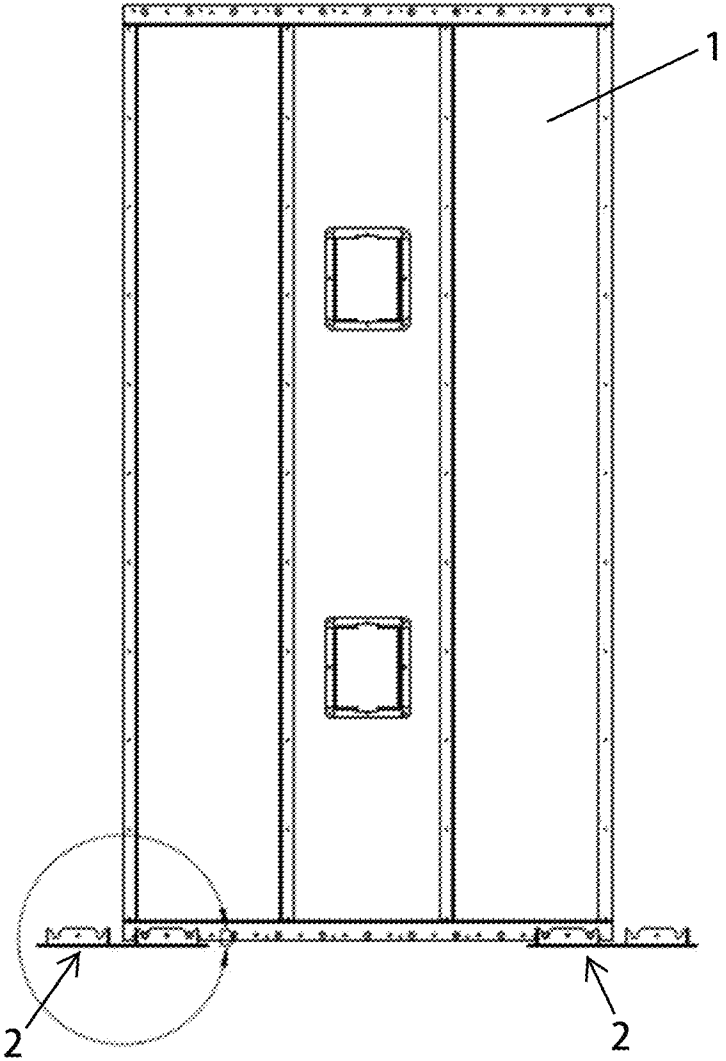
FIG. 8 is a cross-sectional view of the wall panel and interlocking connectors of FIG. 6, taken along line C-C in FIG. 7.
Figure 10:
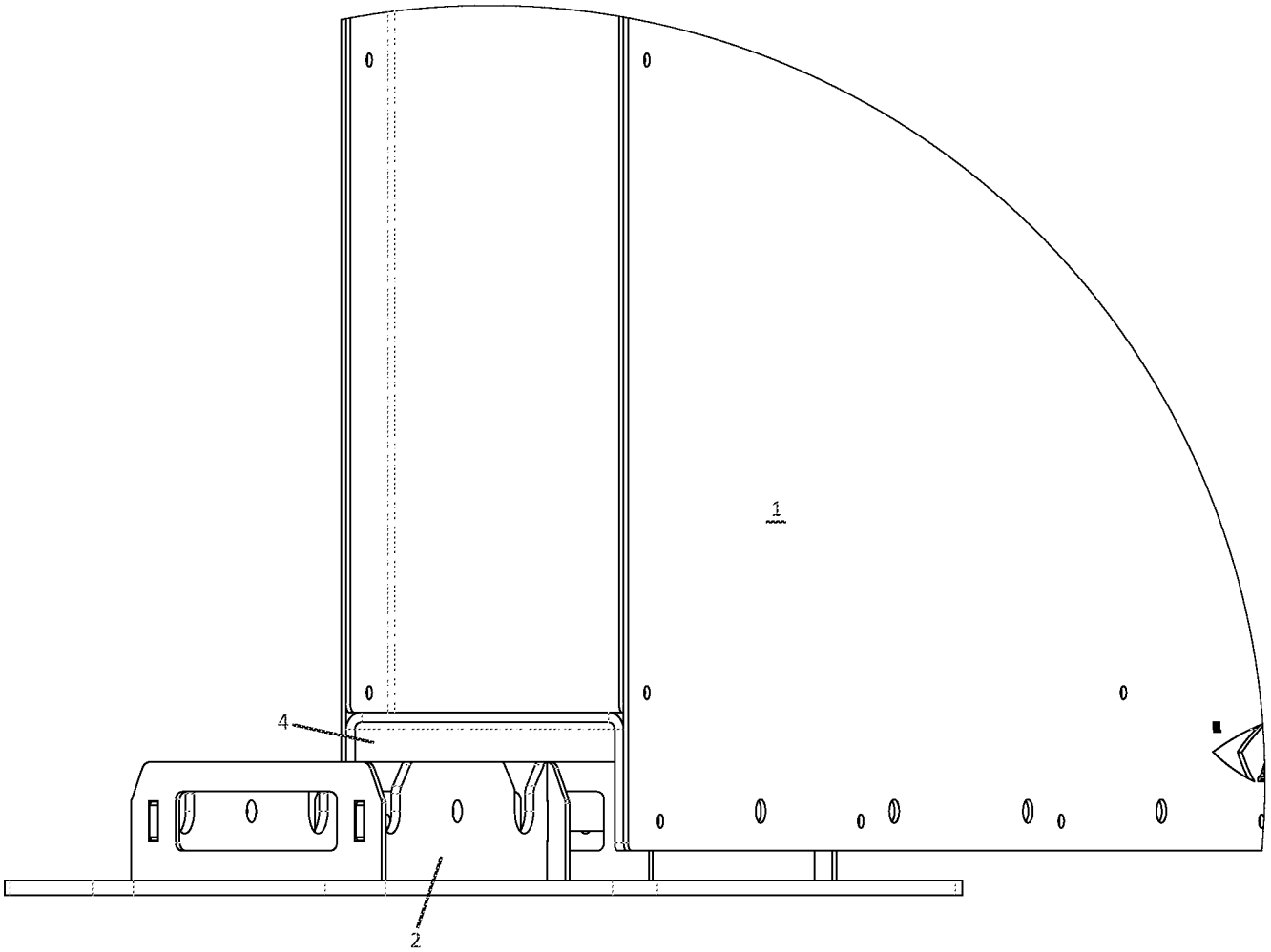
FIG. 10 is a detailed perspective view of a lower corner of the wall panel with a panel interlocking connector in place on the bottom thereof.
Figure 11:
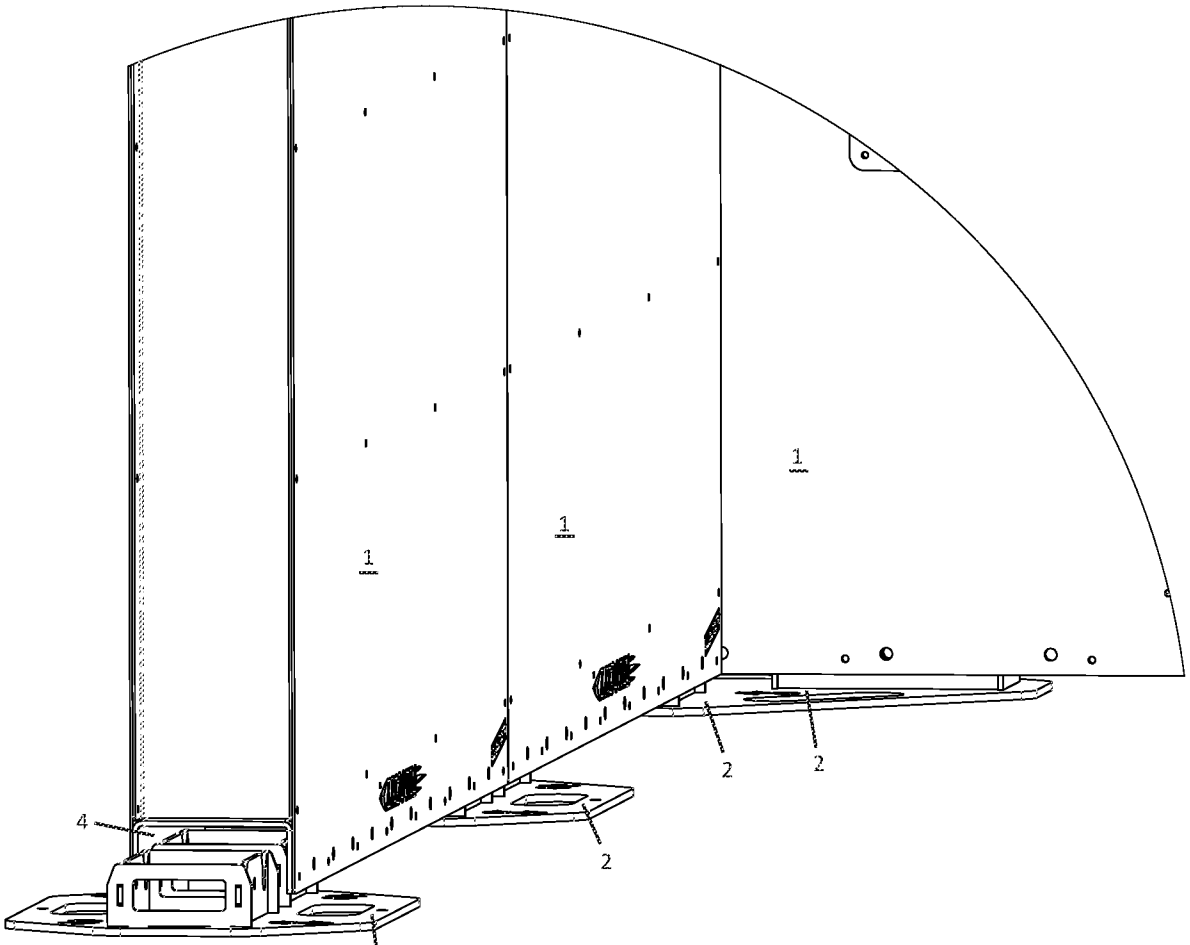
FIG. 11 is a perspective view of a series of wall panels connected on their bottoms with panel interlocking connectors.
Figure 13:
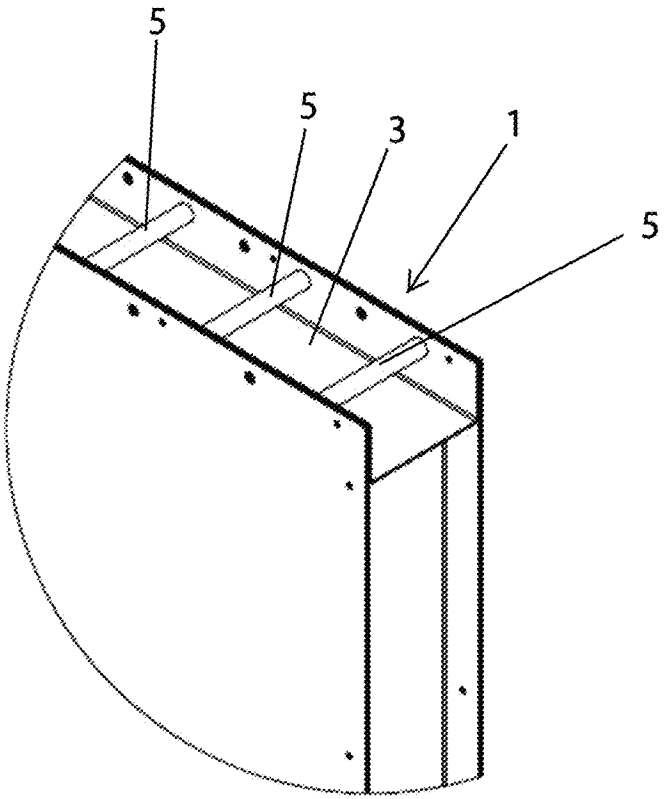
FIG. 13 is a detailed perspective view of an upper corner of the wall panel of FIG. 12.
Figure 12:
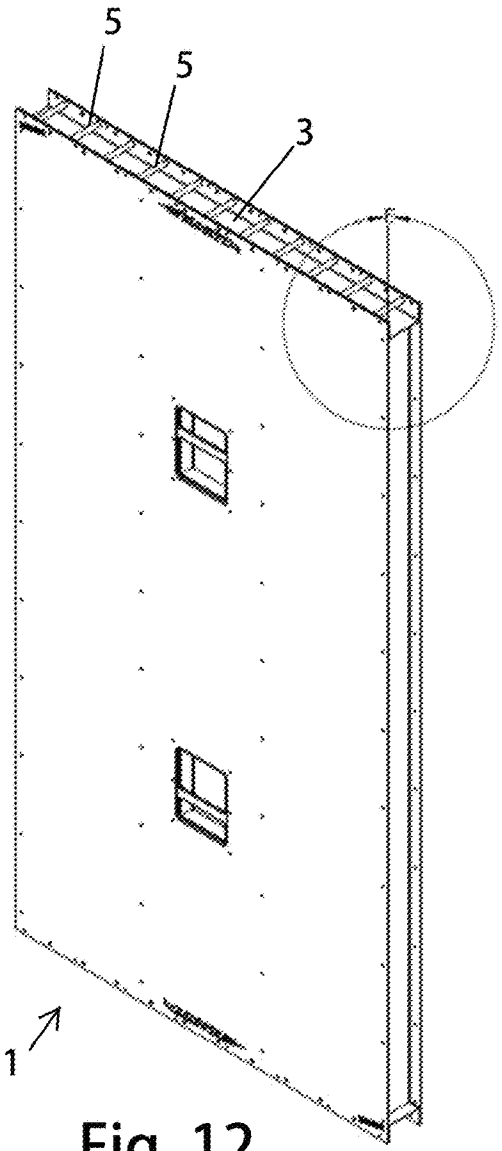
FIG. 12 is a perspective view of a wall panel.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a modular wall system. The modular wall system may be particularly suited for use in law enforcement, emergency services, and military training. The modular wall system may be lightweight, easy to assemble, and appropriate for both indoor and outdoor use. The components of the modular wall system may interlock to form a freestanding structure of any desired configuration, which may be easily disassembled and reassembled in a different configuration and/or in a different location. The modular wall system may not require tools for assembly or disassembly.

The modular wall system may comprise a plurality of wall panels 1 and a plurality of panel interlocking connectors 2. The components of the modular wall system may be constructed of lightweight material, such as aluminum, or any other desired material. The components of the modular wall system may be compatible with non-lethal training ammunition.

The wall panels 1 may each be generally rectangular, or any other desired shape. Each wall panel 1 may have at top channel 3 running horizontally along the top of the panel 1 and a bottom channel 4 running horizontally along the bottom of the panel 1. A plurality of wall pins 5 may span the channels 3 and 4, running between the front and back of the panel 1. The wall pins 5 may be evenly spaced along the entire length of the channels 3 and 4. For example, the wall pins 5 may be spaced in four-inch increments, or may be spaced at any other desired interval. In some varieties of the wall panel 1, the top channel 3 and the bottom channel 4 may be identical.

The modular wall system may include multiple varieties of wall panels 1. For example, one variety of wall panel 1 may be a standard wall panel, as shown in FIGS. 1 through 18. Another variety of wall panel 1 may include a window 6, as shown in FIGS. 19 through 23. Yet another variety of wall panel 1 may include a door 7, as shown in FIGS. 24 through 28. Other possible varieties of wall panel 1 may include other styles of windows 6, other styles of doors 7, multiple windows 6, multiple doors 7, a combination of one or more windows 6 and one or more doors 7, or other features as desired. The modular wall system may include only one of these varieties, more than one of these varieties, or all of these varieties, each in any desired quantities.

Each wall panel 1 may be constructed of a plurality of sheet metal channels 8 forming a basic structure, which may be sandwiched between and attached to two sheet metal skins 9. Alternately, the channels 8 and/or skins 9 may be made of a different material than sheet metal, as desired.

Figure 14:
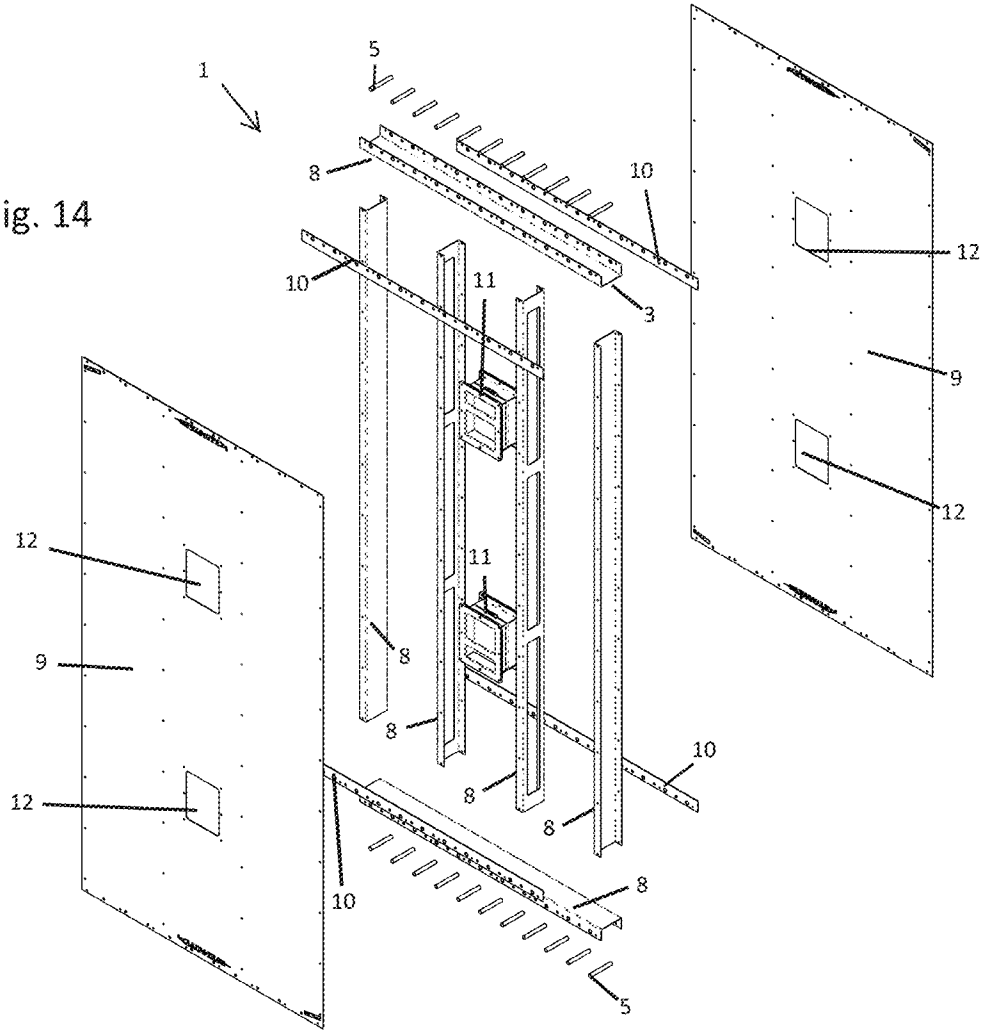
FIG. 14 is an exploded perspective view of a wall panel of the modular wall system.
Figure 16:
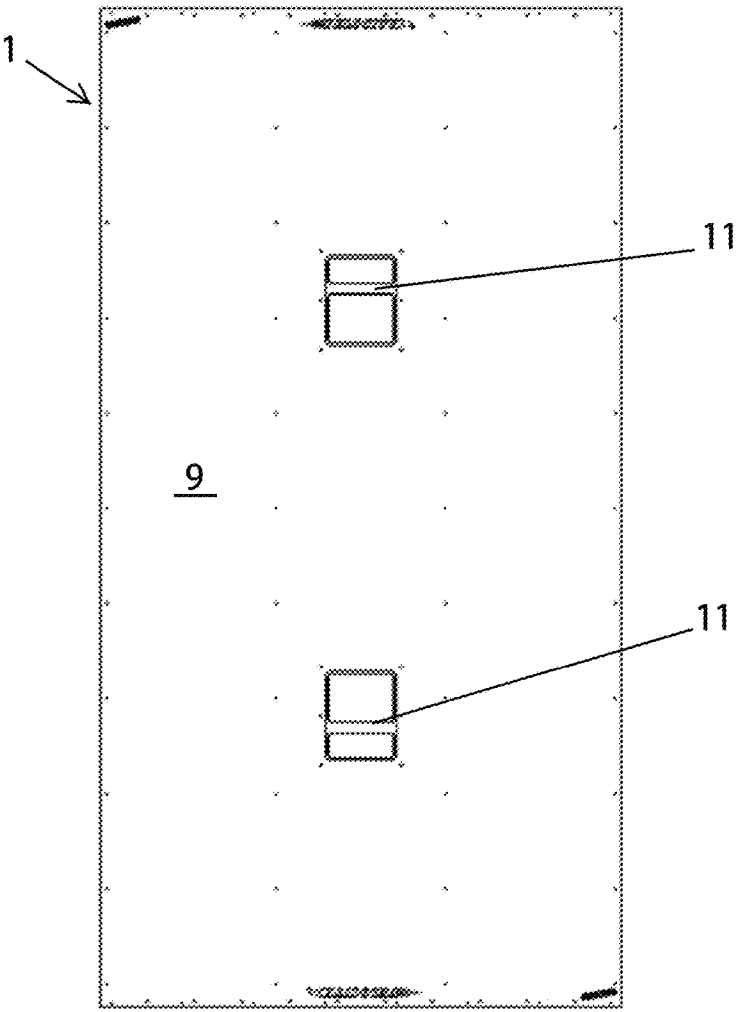
FIG. 16 is a front view of the wall panel.
Figure 15:
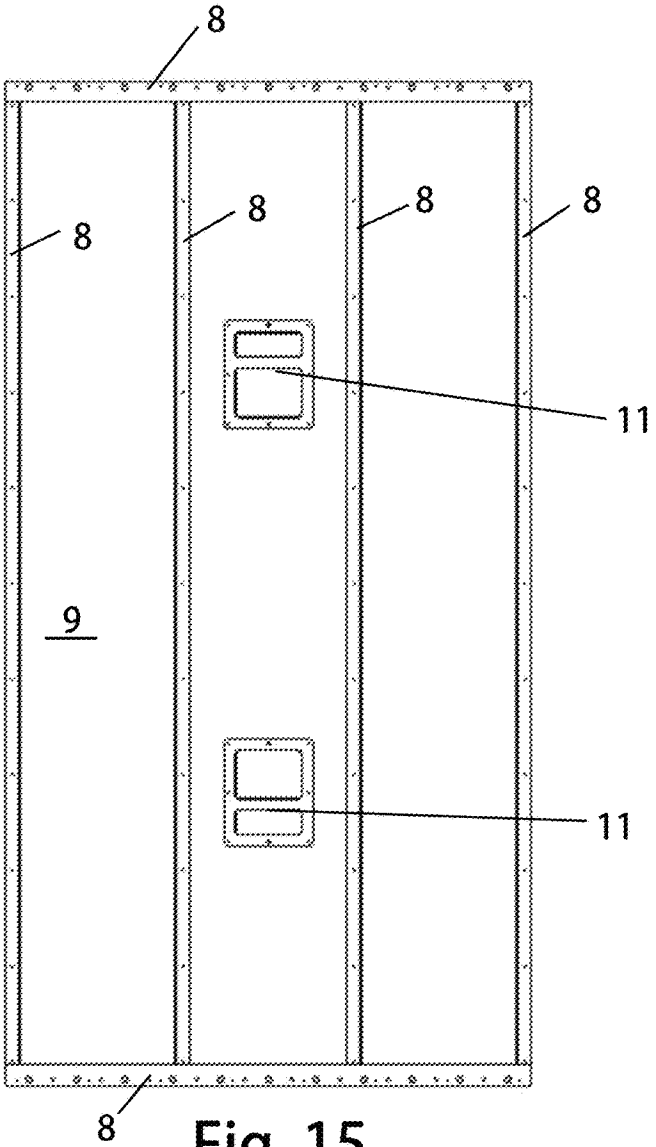
FIG. 15 is a front view of the wall panel with one skin omitted to show interior construction.
Figure 18:
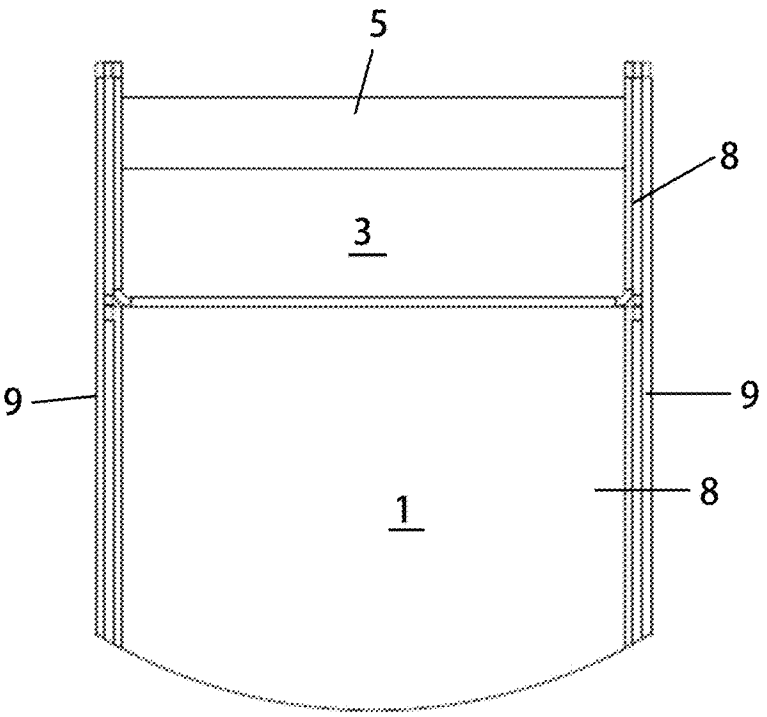
FIG. 18 is a detailed side view of a top corner of the wall panel.
Figure 17:
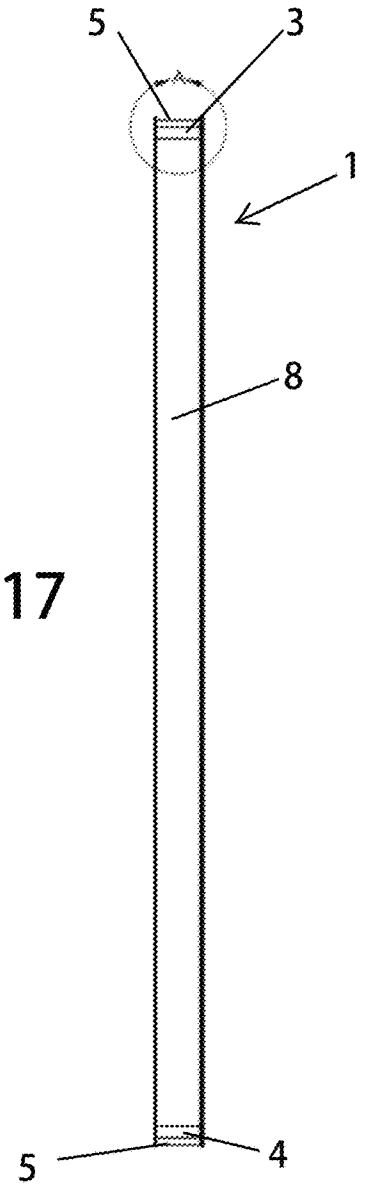
FIG. 17 is a side view of the wall panel.
Figure 21:
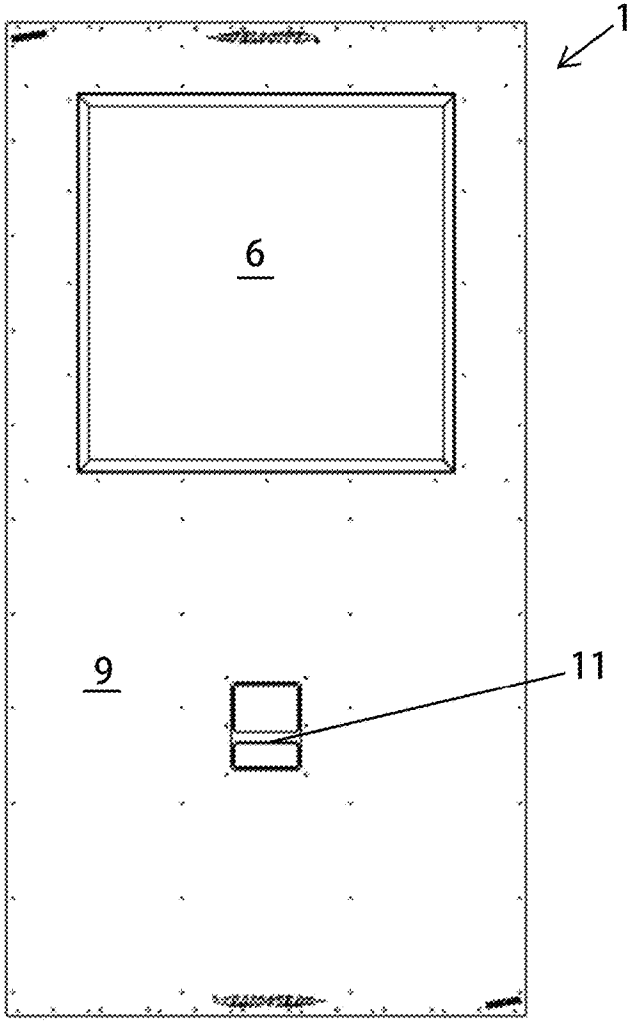
FIG. 21 is a front view of the wall panel with a window.
Figure 20:
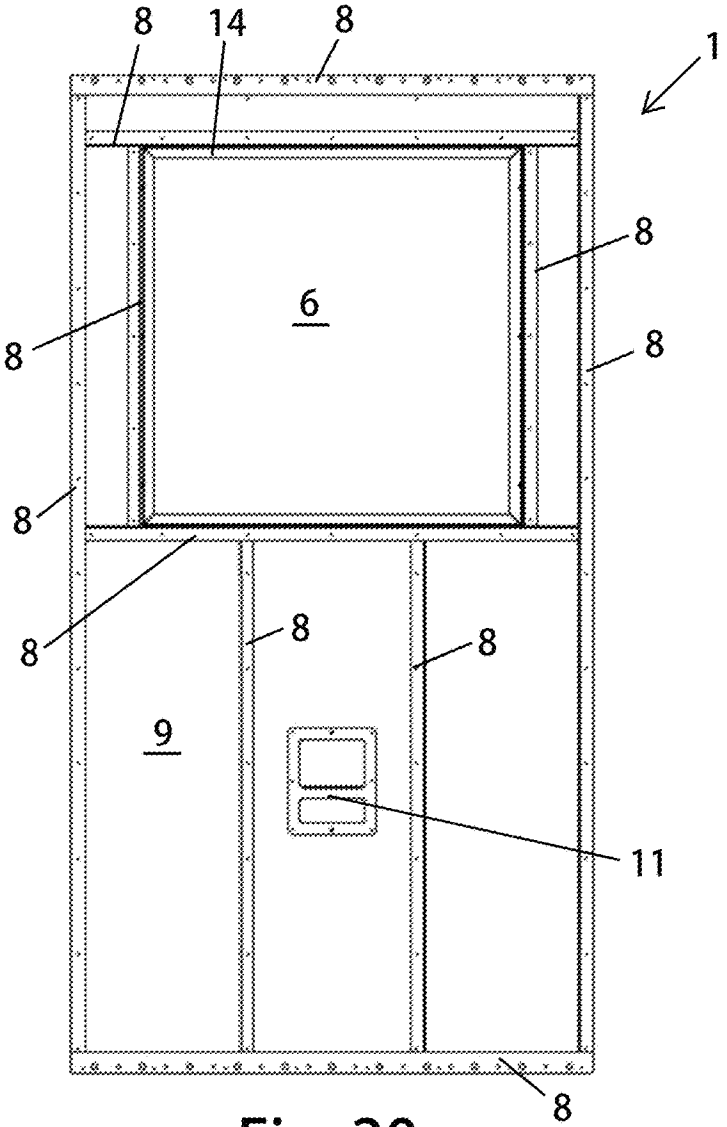
FIG. 20 is a front view of the wall panel with a window with one skin omitted to show interior construction.
Figure 23:
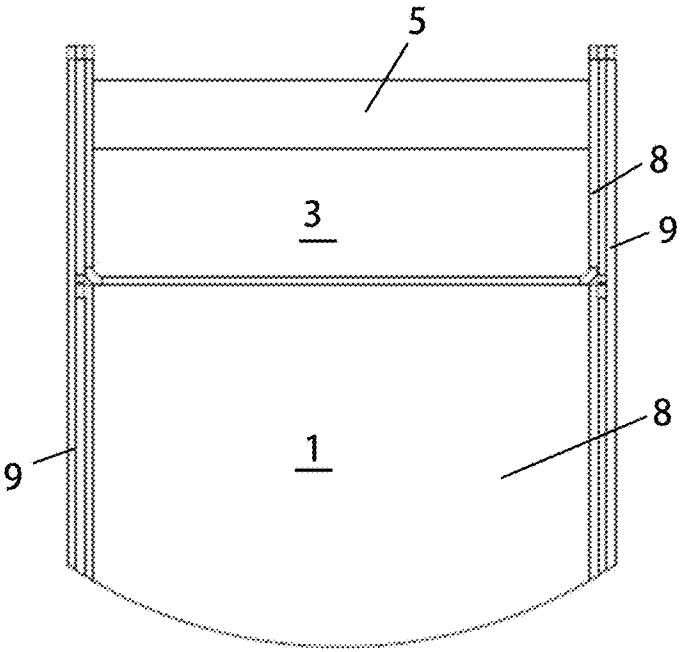
FIG. 23 is a detailed side view of a top corner of the wall panel with a window.
Figure 22:
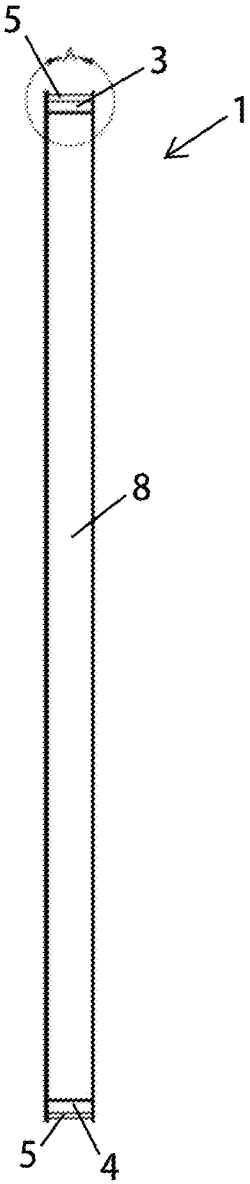
FIG. 22 is a side view of the wall panel with a window.
Figure 24:
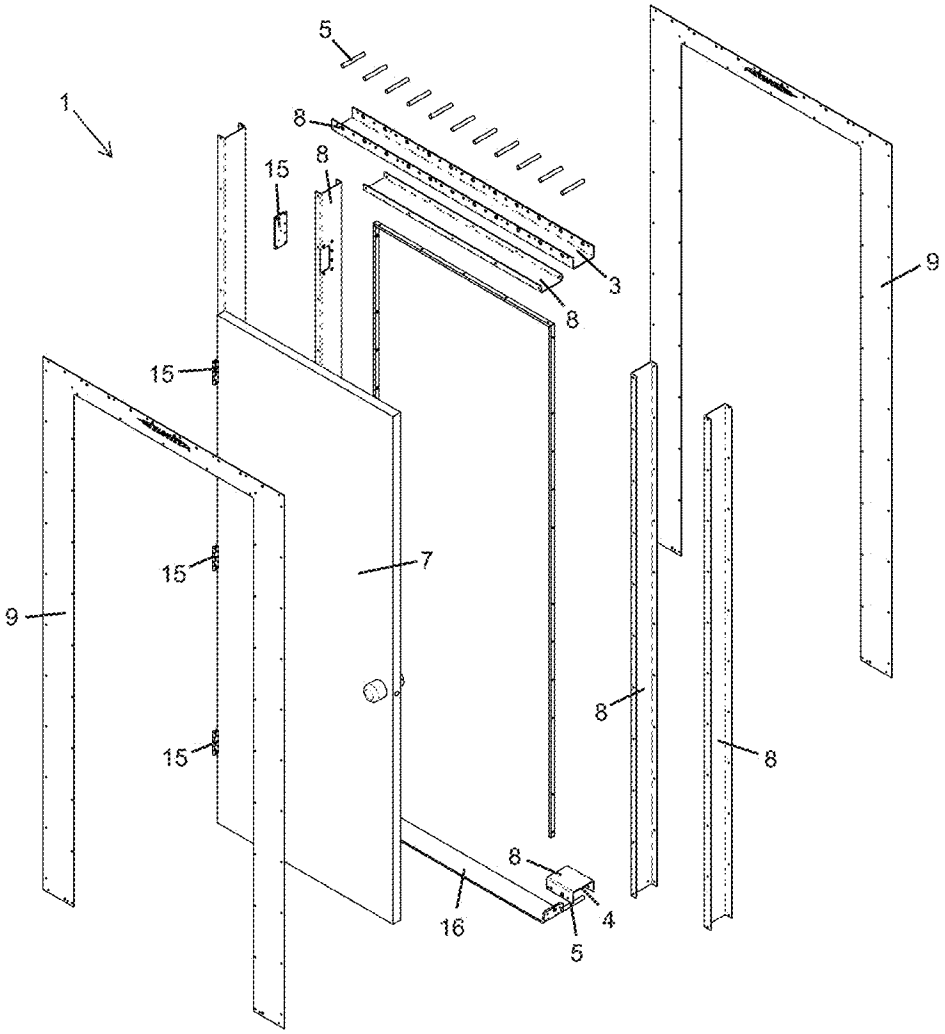
FIG. 24 is an exploded perspective view of a wall panel of the modular wall system, where the wall panel has a door.
Figure 26:
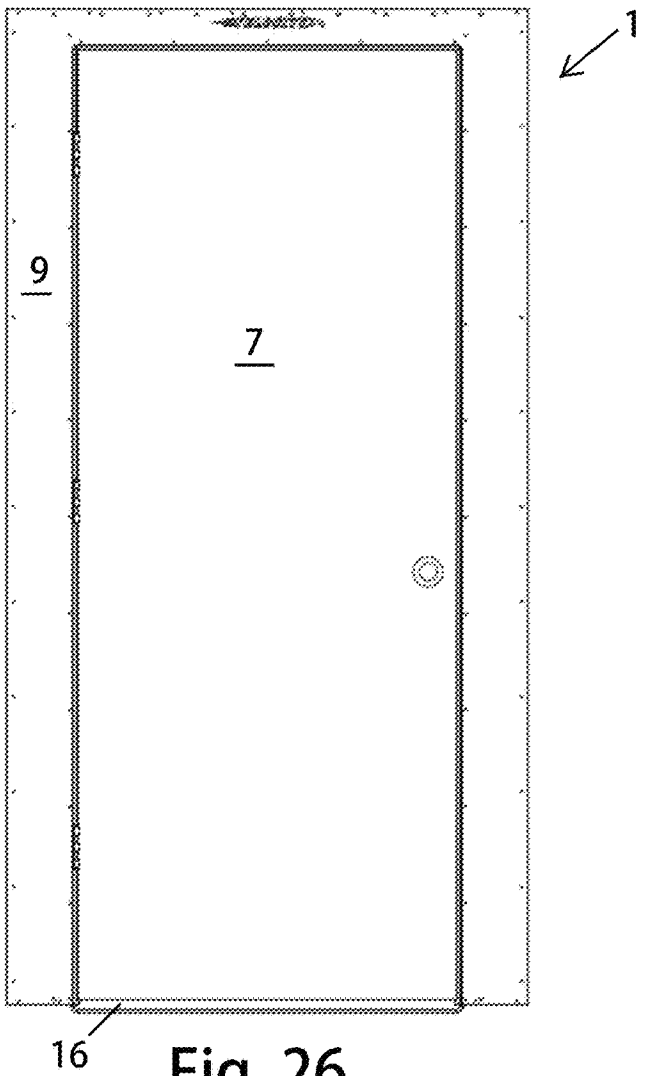
FIG. 26 is a front view of the wall panel with a door.
Figure 25:
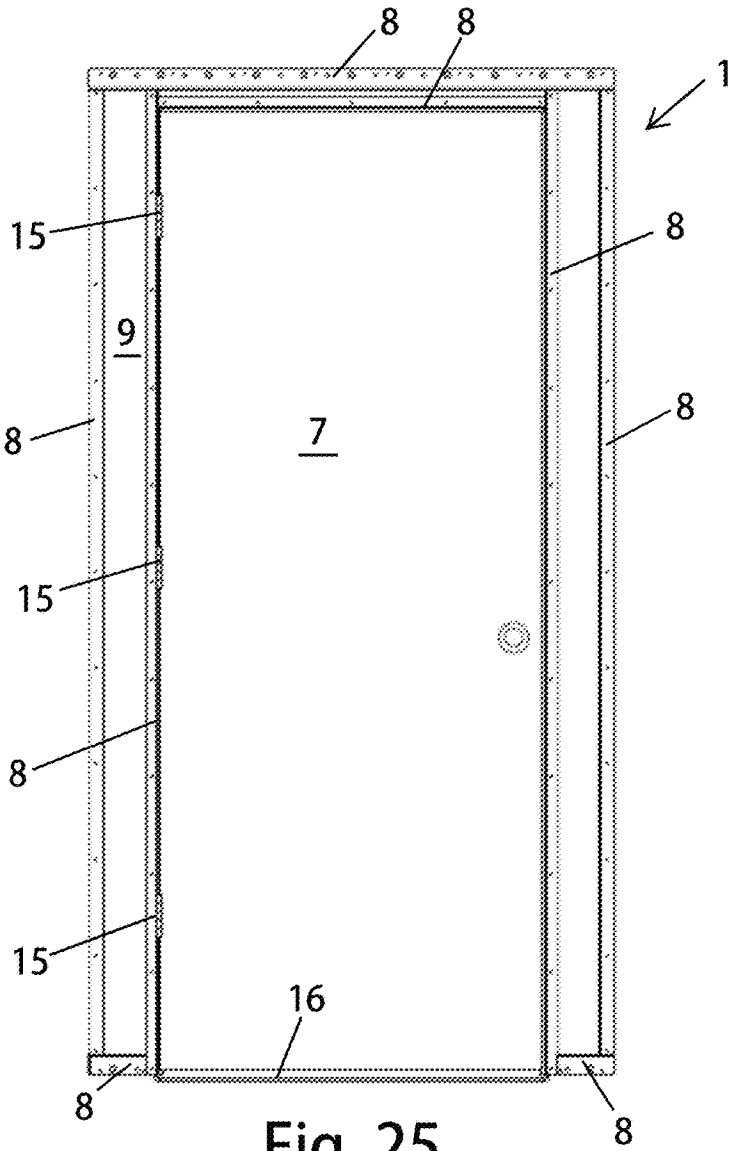
FIG. 25 is a front view of the wall panel with a door with one skin omitted to show interior construction.
Figure 28:
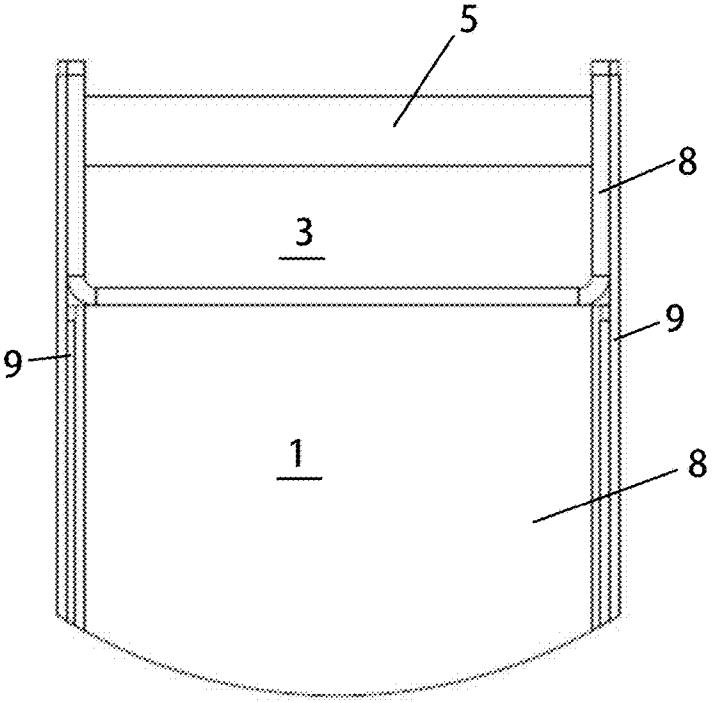
FIG. 28 is a detailed side view of a top corner of the wall panel with a door.
Figure 27:
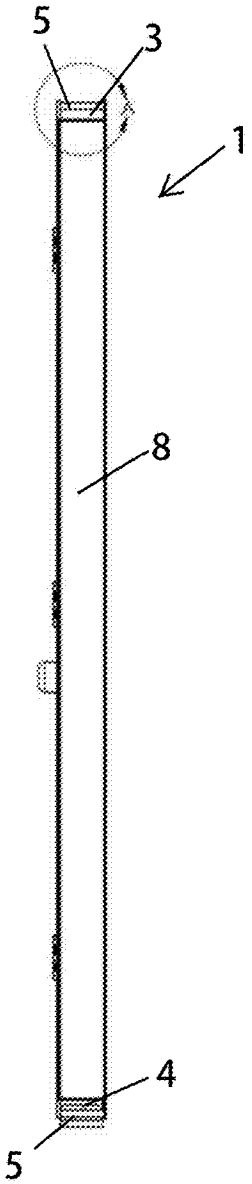
FIG. 27 is a side view of the wall panel with a door.
Figure 29:
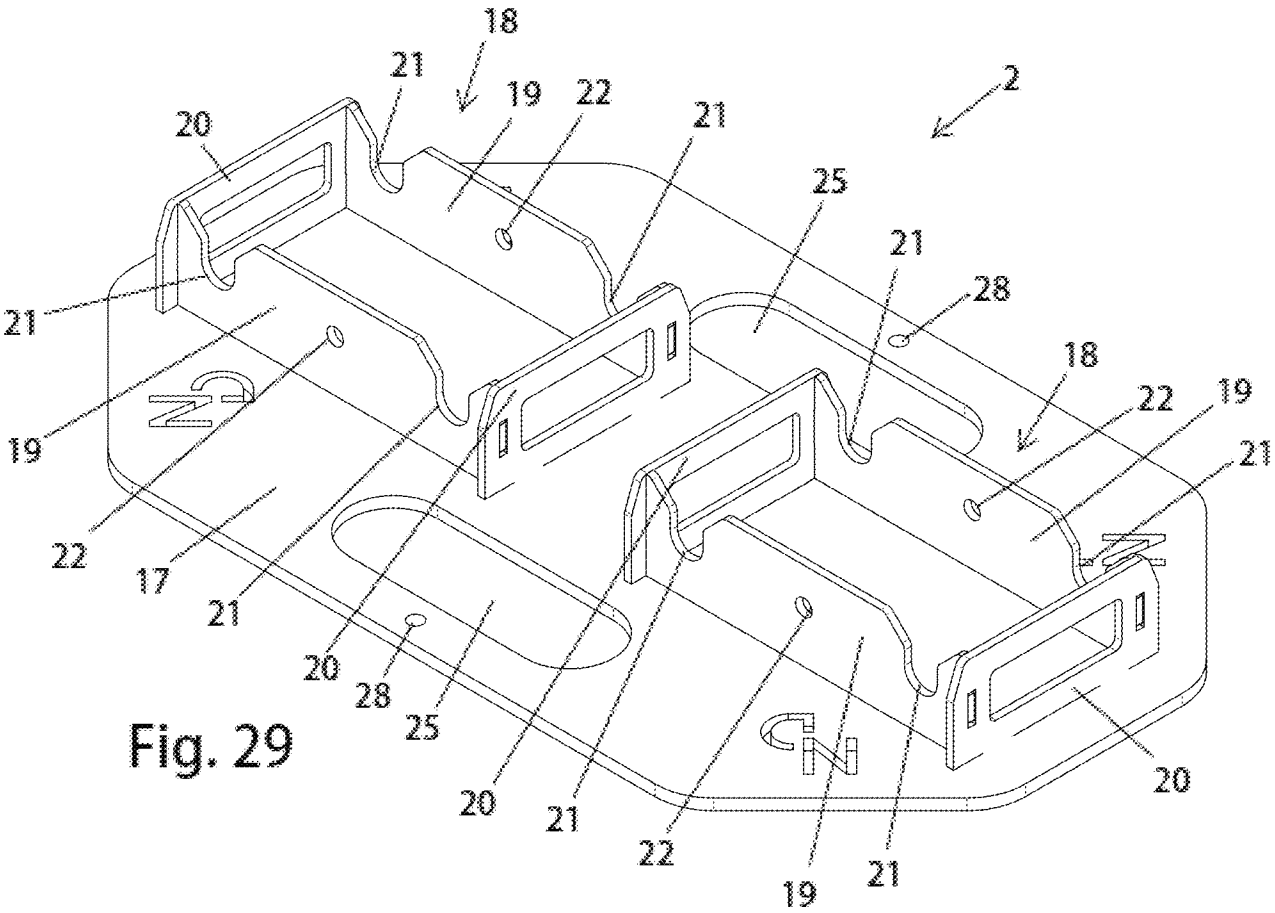
FIG. 29 is a perspective view of a straight panel interlocking connector.
Figure 30:
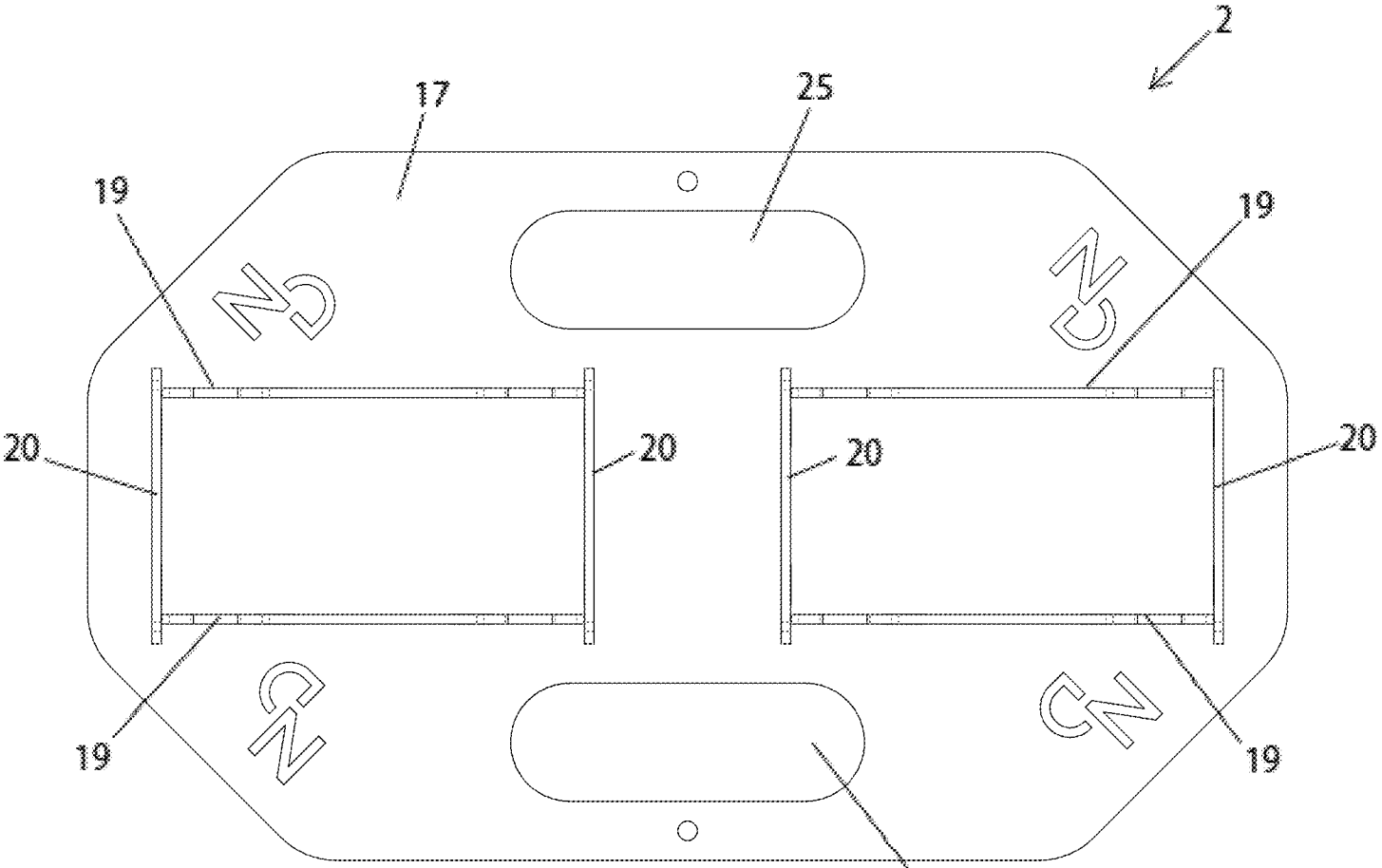
FIG. 30 is a plan view of the straight panel interlocking connector.
Figure 31:
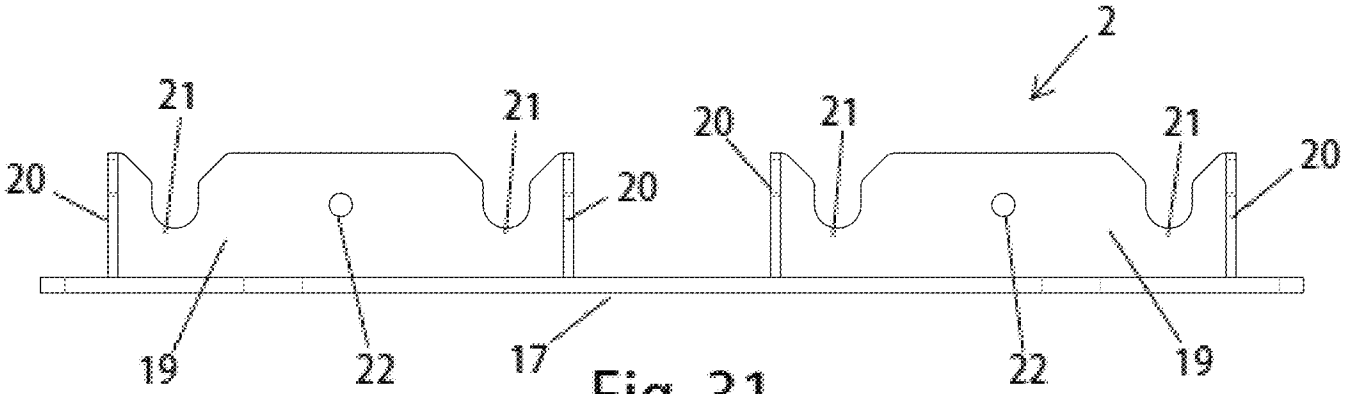
FIG. 31 is a side view of the straight panel interlocking connector.
Figure 32:
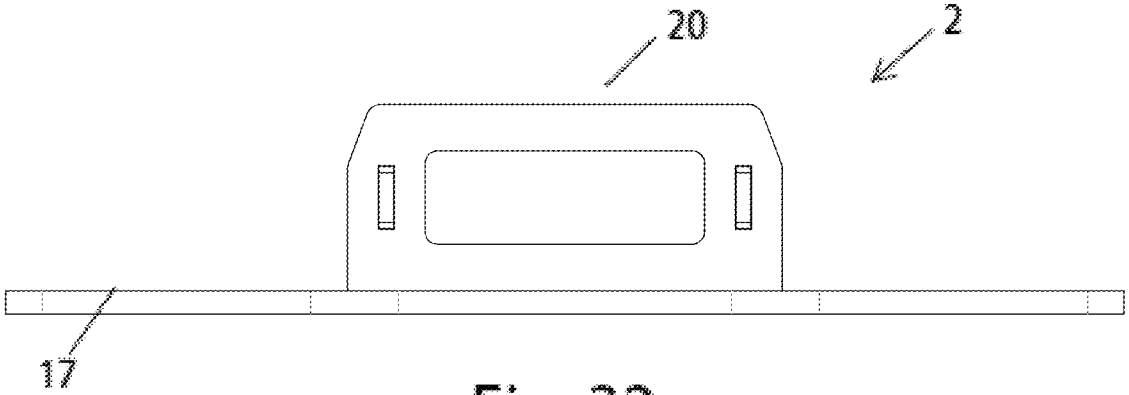
FIG. 32 is a front view of the straight panel interlocking connector.
Figure 33:
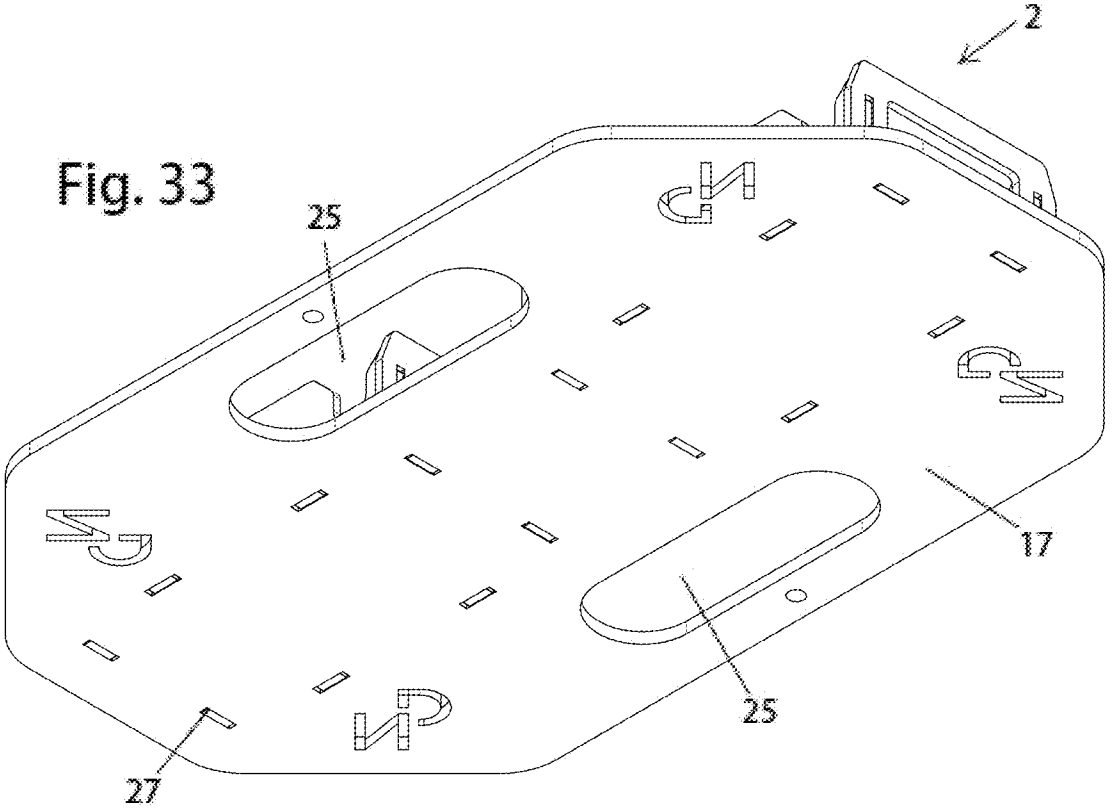
FIG. 33 is a perspective view of the straight panel interlocking connector.
Figure 34:
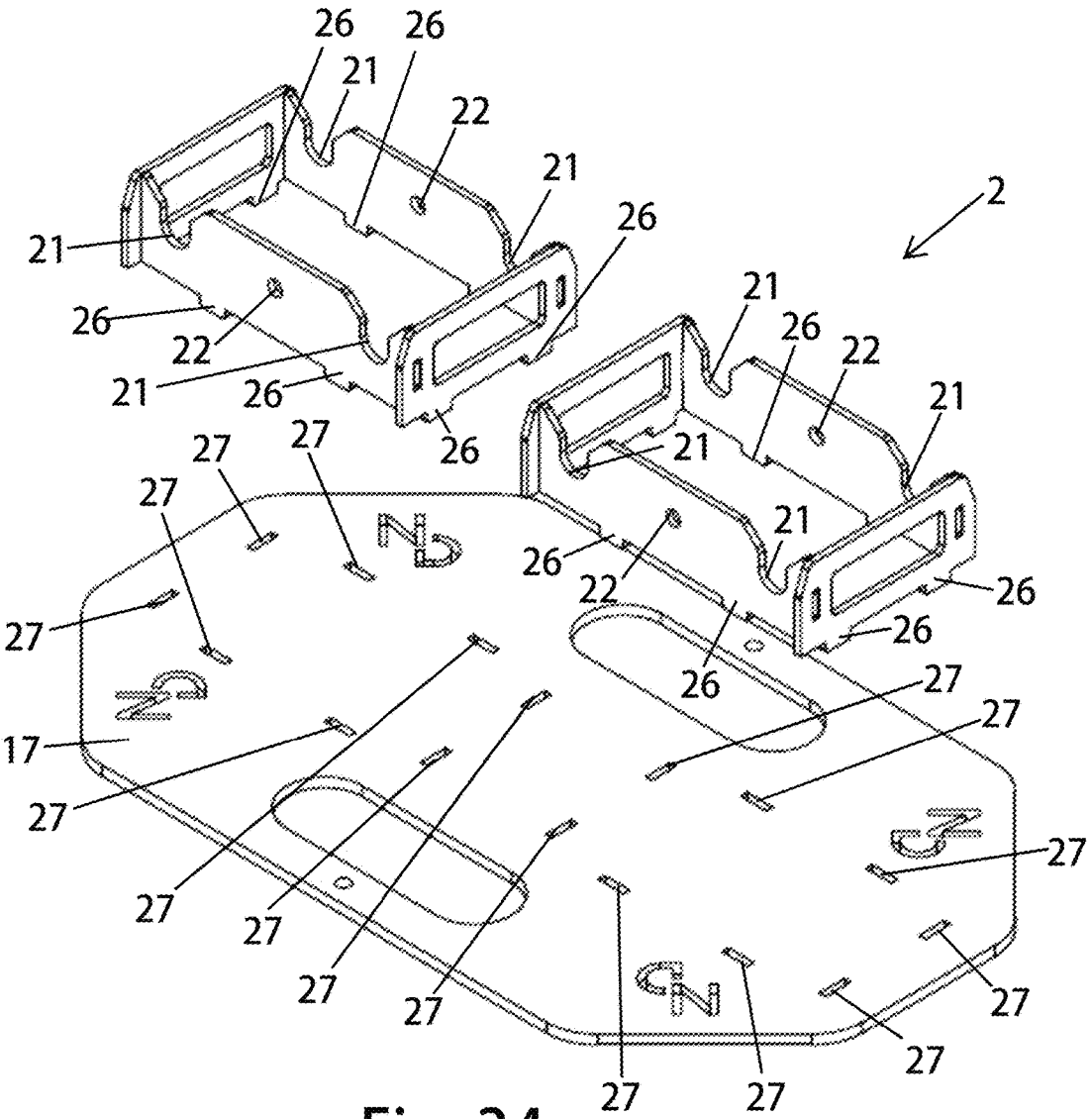
FIG. 34 is an exploded perspective view of the straight panel interlocking connector.
Figure 35:
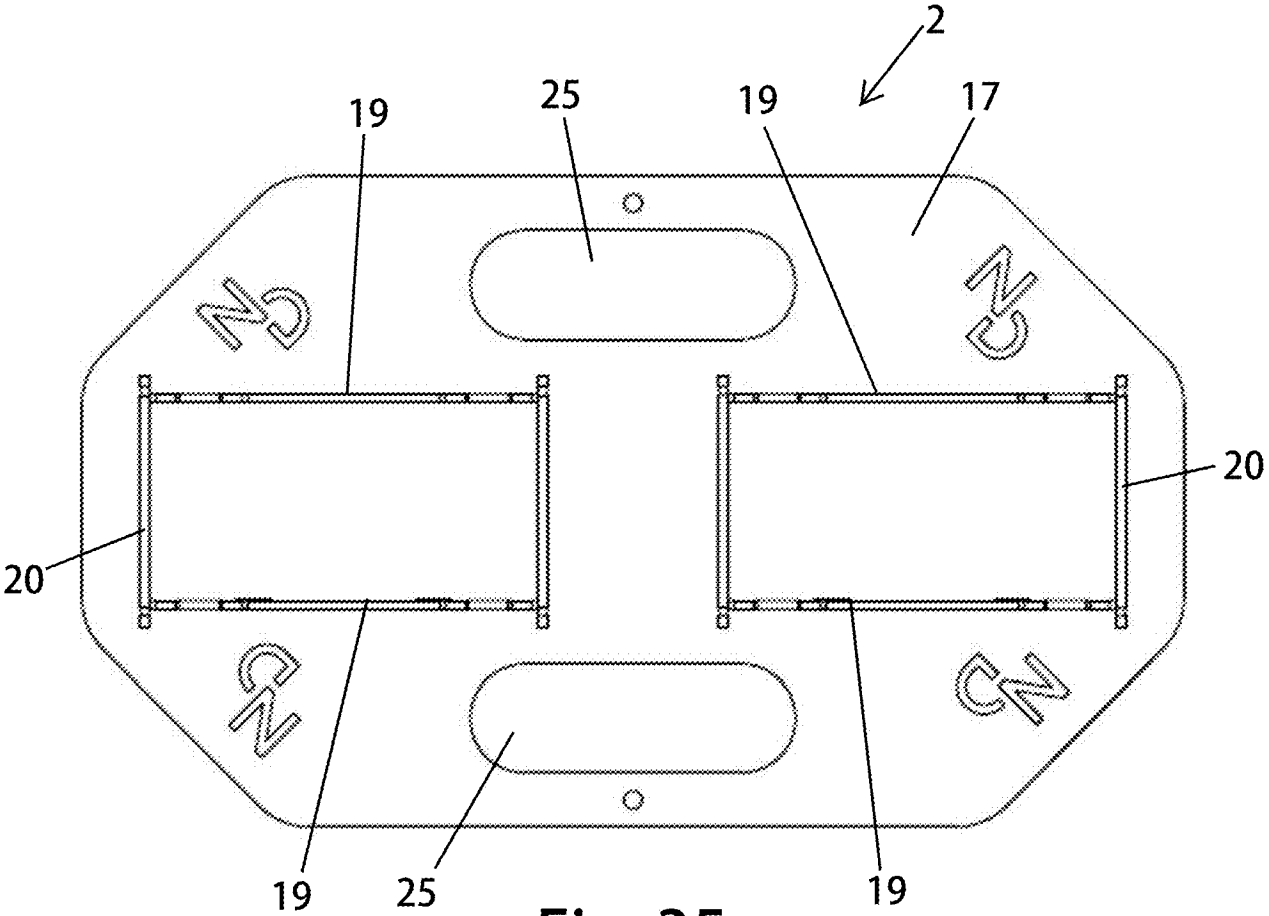
FIG. 35 is a plan view of the straight panel interlocking connector.
Figure 36:
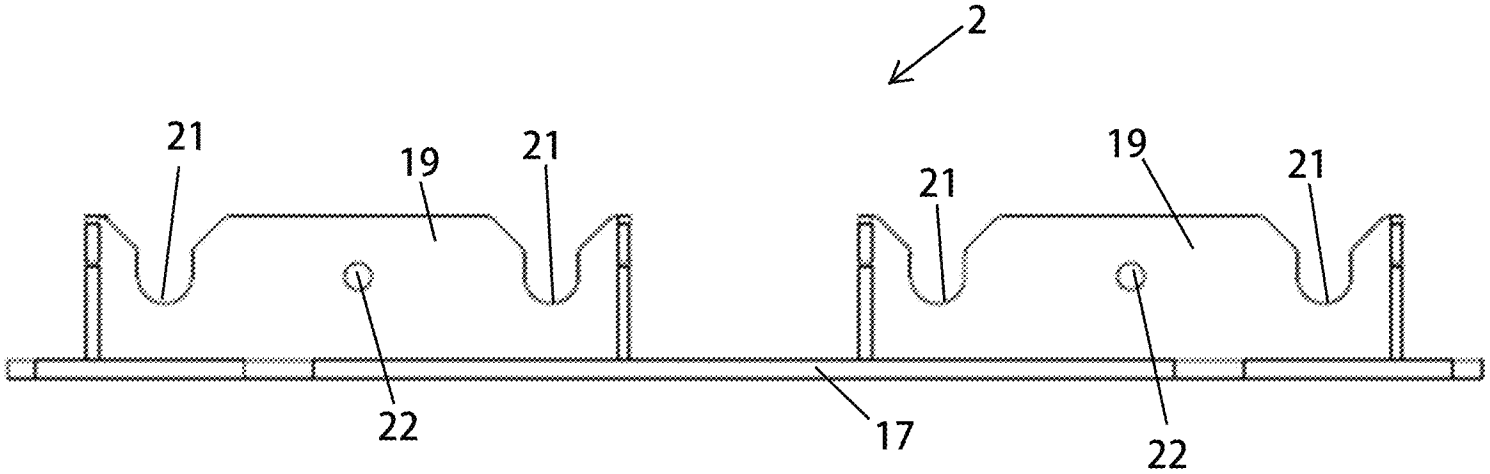
FIG. 36 is a side view of the straight panel interlocking connector.
Figure 37:
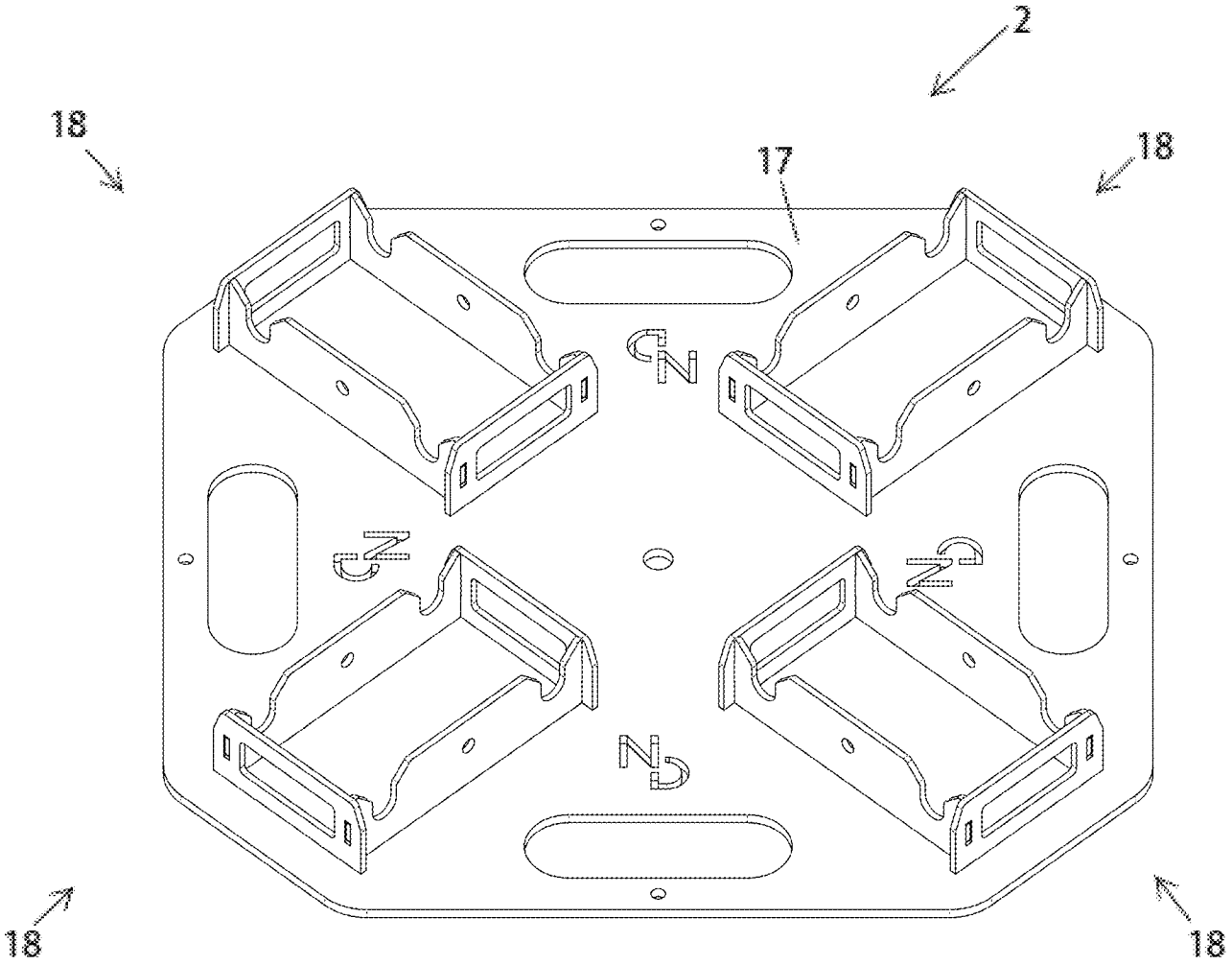
FIG. 37 is a perspective view of a cross-shaped panel interlocking connector.
Figure 38:
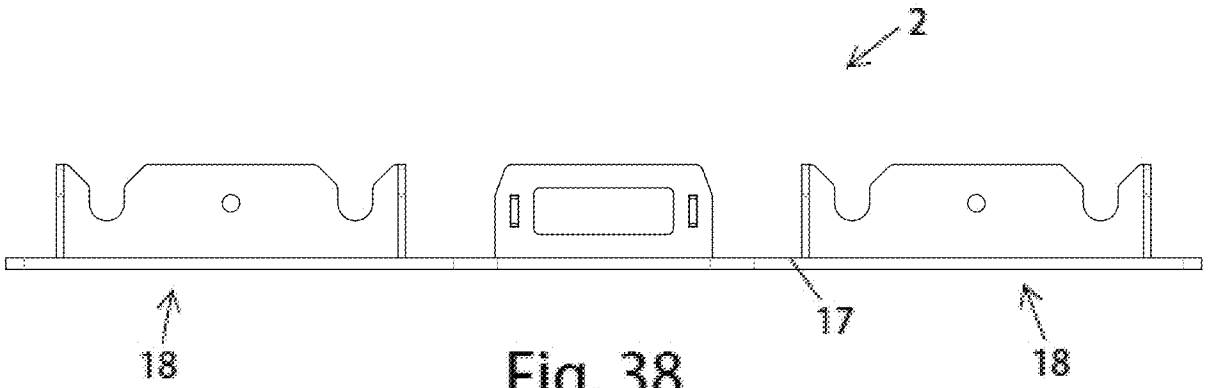
FIG. 38 is a side view of the cross-shaped panel interlocking connector, as viewed looking directly at one of the short sides of the panel interlocking connector.
Figure 39:
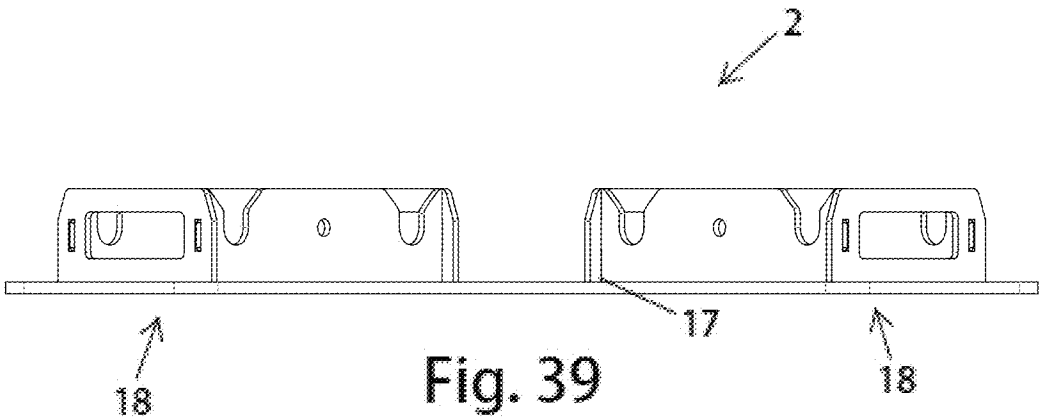
FIG. 39 is a side view of the cross-shaped panel interlocking connector, as viewed looking directly at one of the long sides of the panel interlocking connector.
Figure 40:
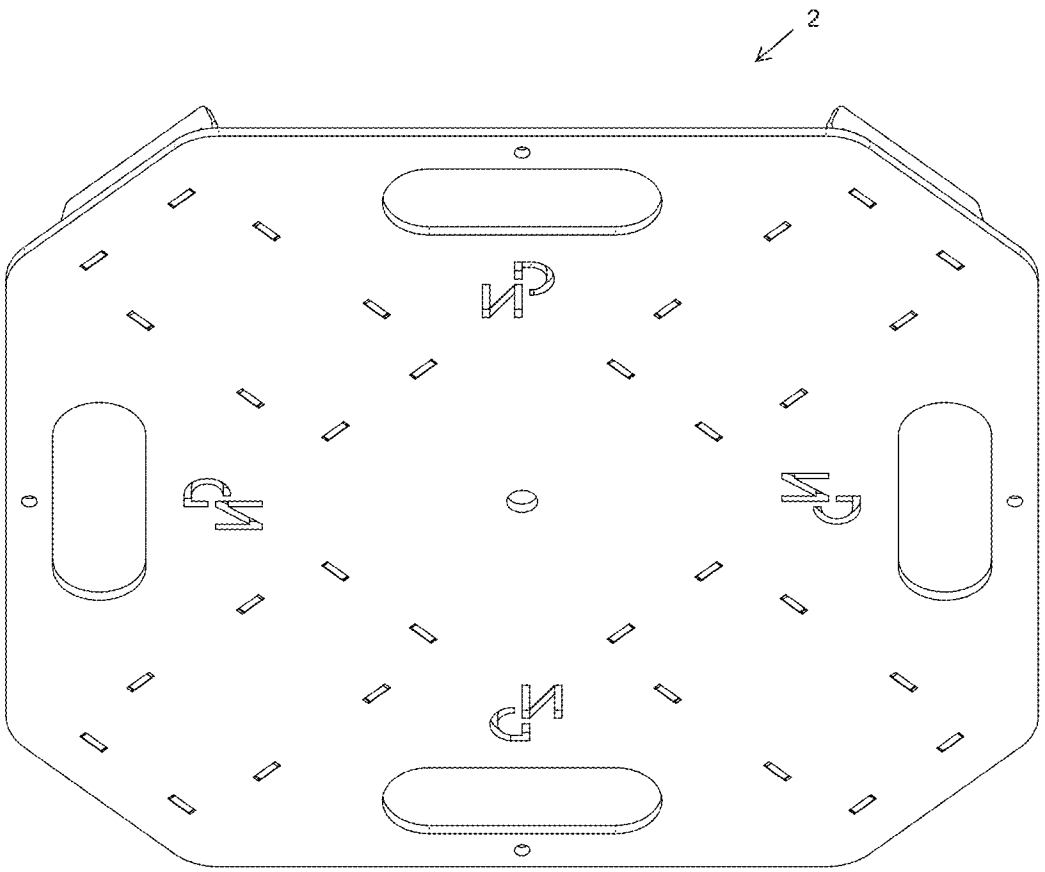
FIG. 40 is a perspective view of the cross-shaped panel interlocking connector.
Figure 41:
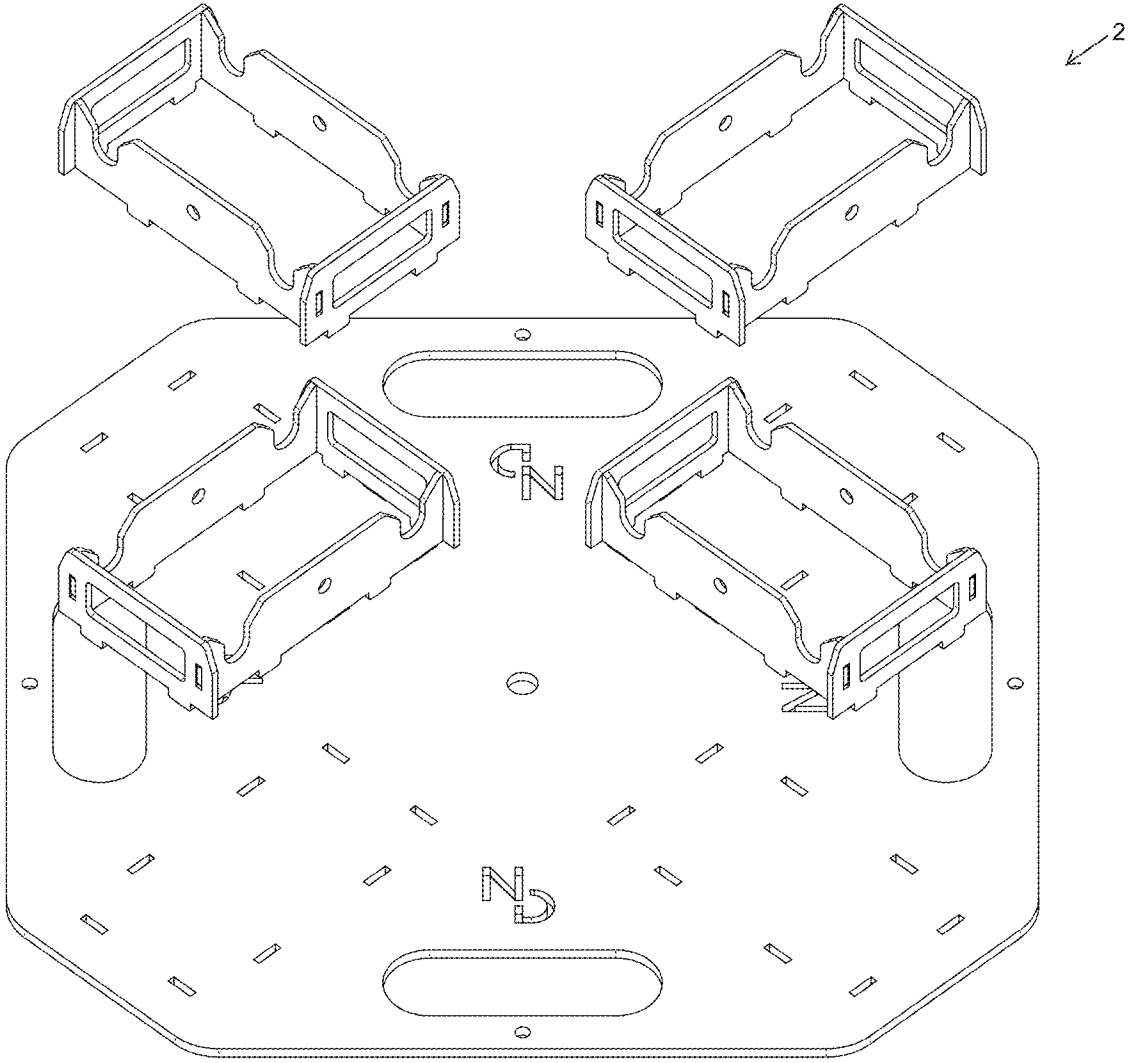
FIG. 41 is an exploded perspective view of the cross-shaped panel interlocking connector.
Figure 42:
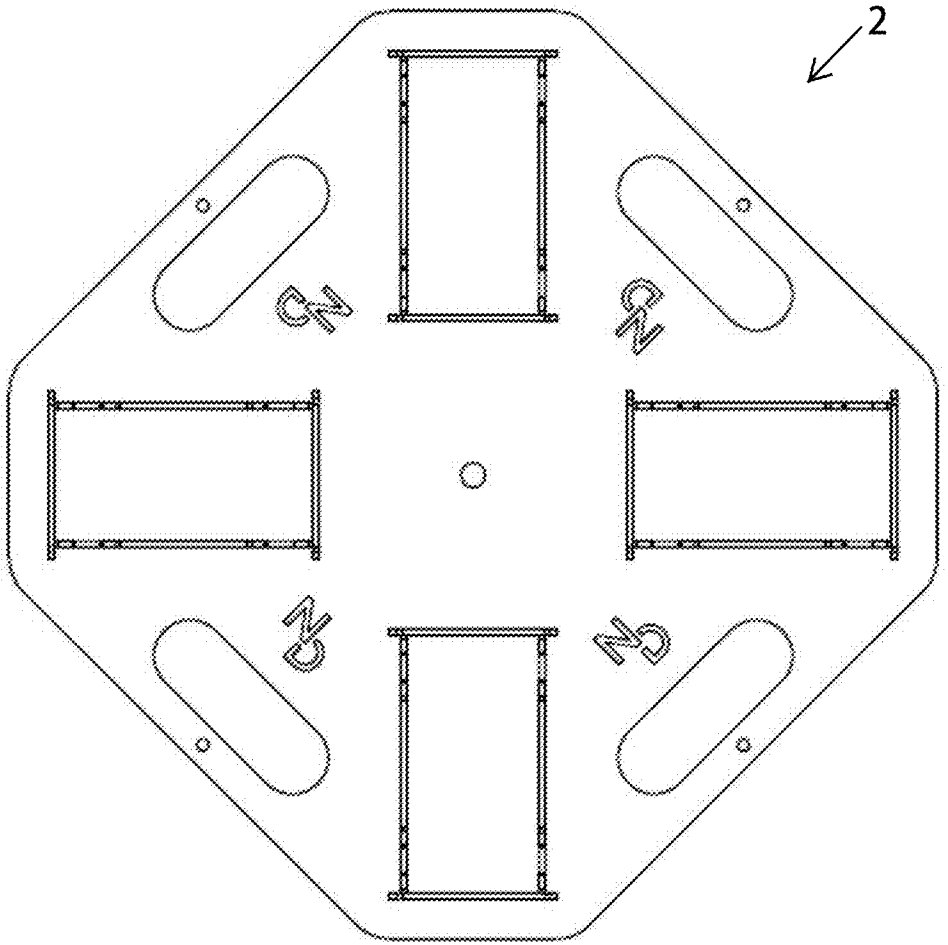
FIG. 42 is a plan view of the cross-shaped panel interlocking connector.
Figure 43:
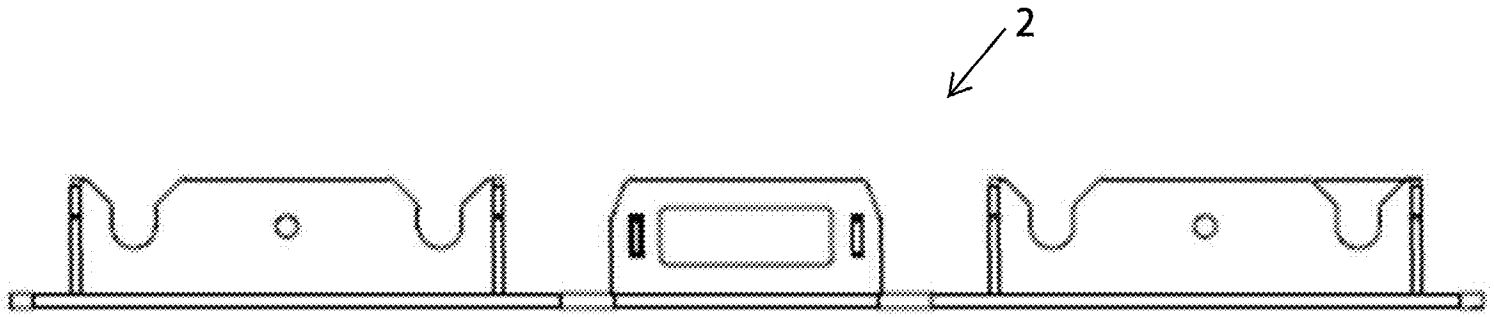
FIG. 43 is a side view of the cross-shaped panel interlocking connector, as viewed looking directly at one of the short sides of the panel interlocking connector.
Figure 44:
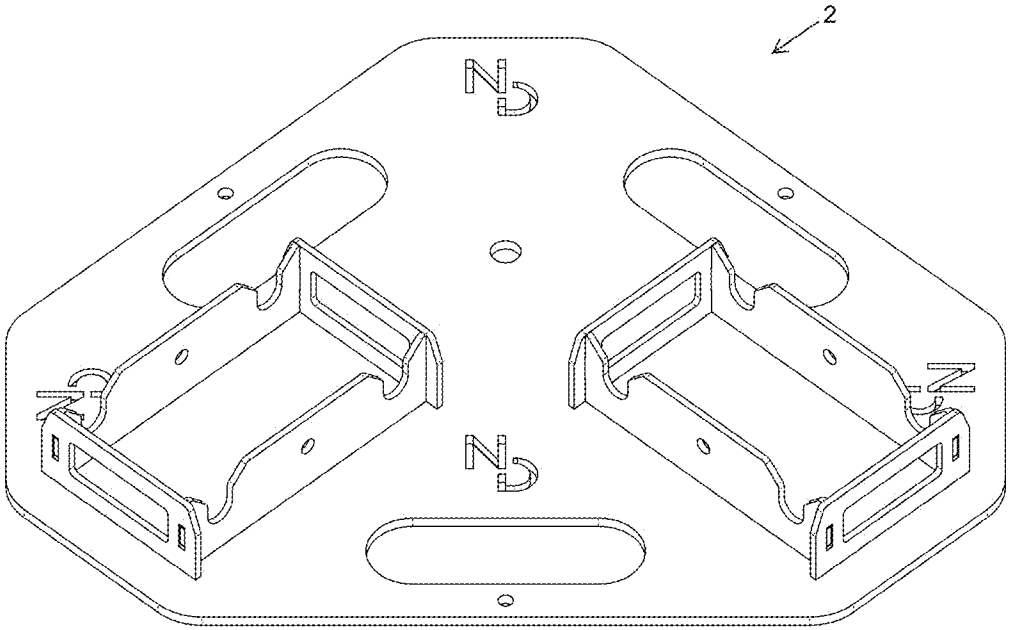
FIG. 44 is a perspective view of a corner panel interlocking connector.
Figure 45:
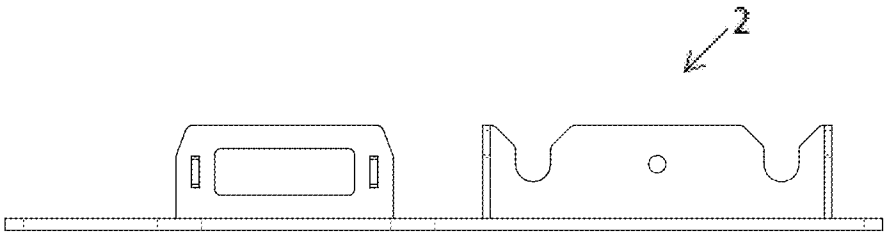
FIG. 45 is a side view of the corner panel interlocking connector, as viewed looking directly at one of the short sides of the panel interlocking connector.
Figure 46:
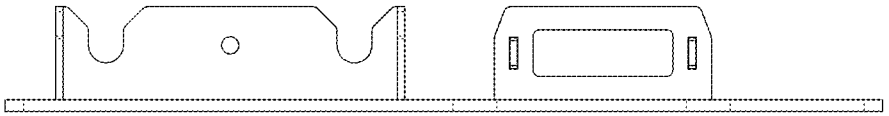
FIG. 46 is a side view of the corner panel interlocking connector, as viewed looking directly at the other of the short sides of the panel interlocking connector.
Figure 47:
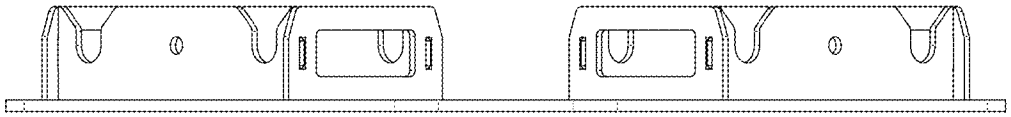
FIG. 47 is a side view of the corner panel interlocking connector, as viewed looking directly at one of the long sides of the panel interlocking connector.
Figure 48:
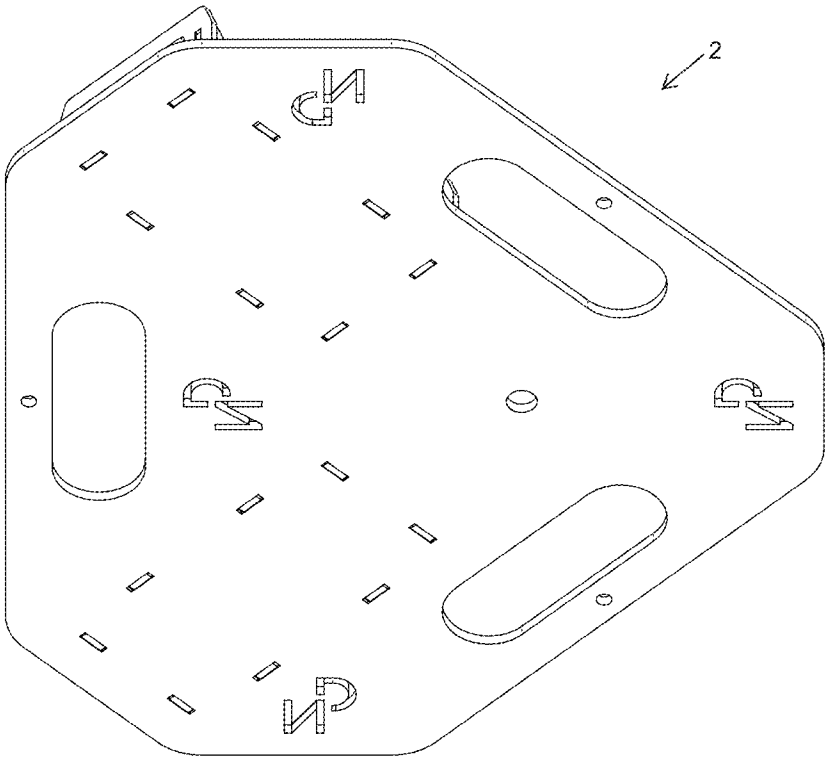
FIG. 48 is a perspective view of the corner panel interlocking connector.
Figure 49:
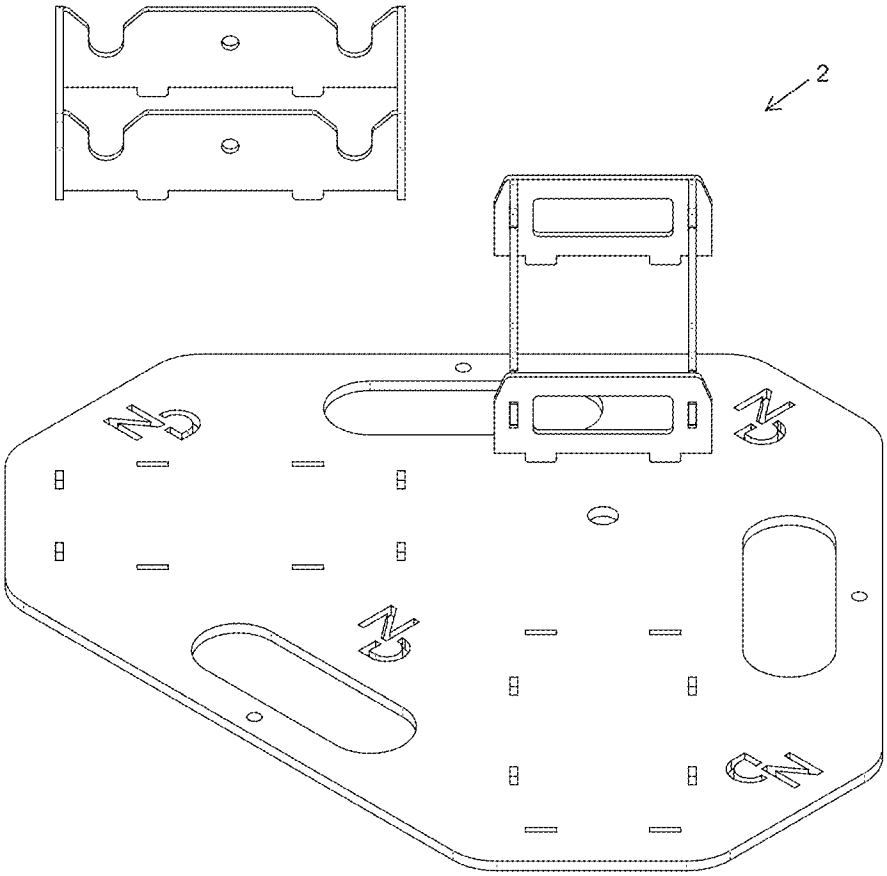
FIG. 49 is an exploded perspective view of the corner panel interlocking connector.
Figure 50:
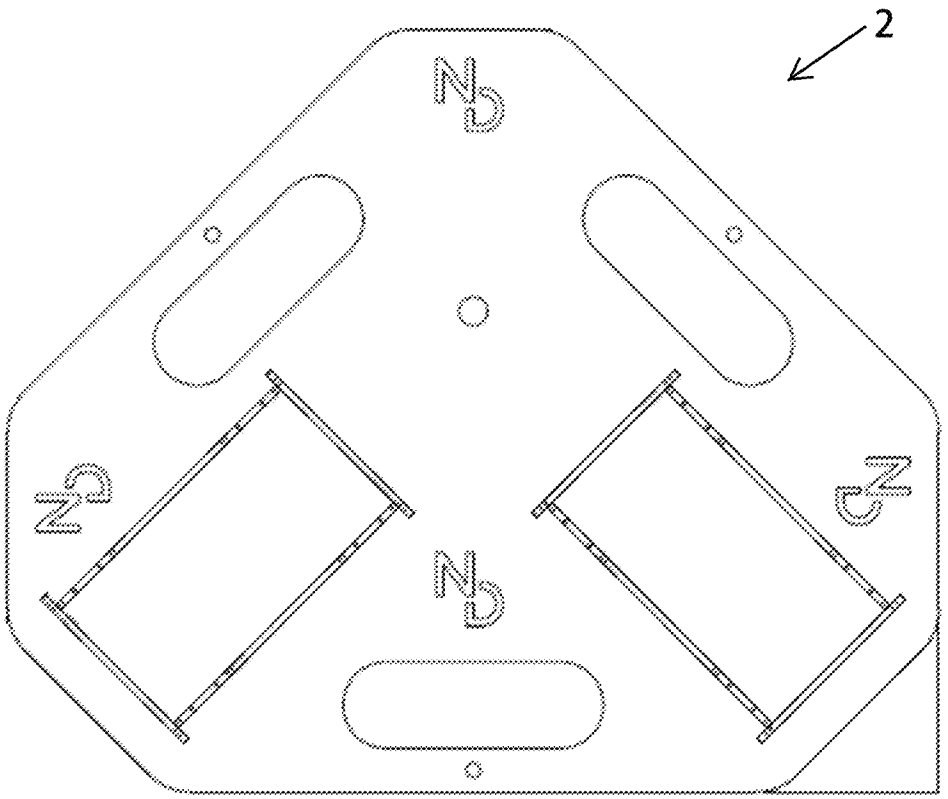
FIG. 50 is a plan view of the corner panel interlocking connector.
Figure 51:
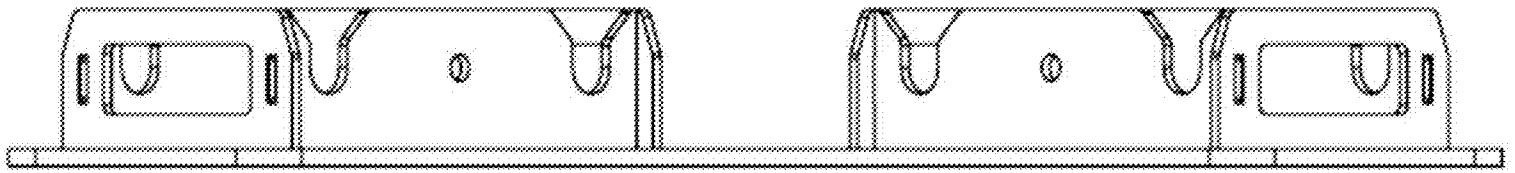
FIG. 51 is a side view of the corner panel interlocking connector, as viewed locking directly at one of the long sides of the panel interlocking connector.
Figure 52:
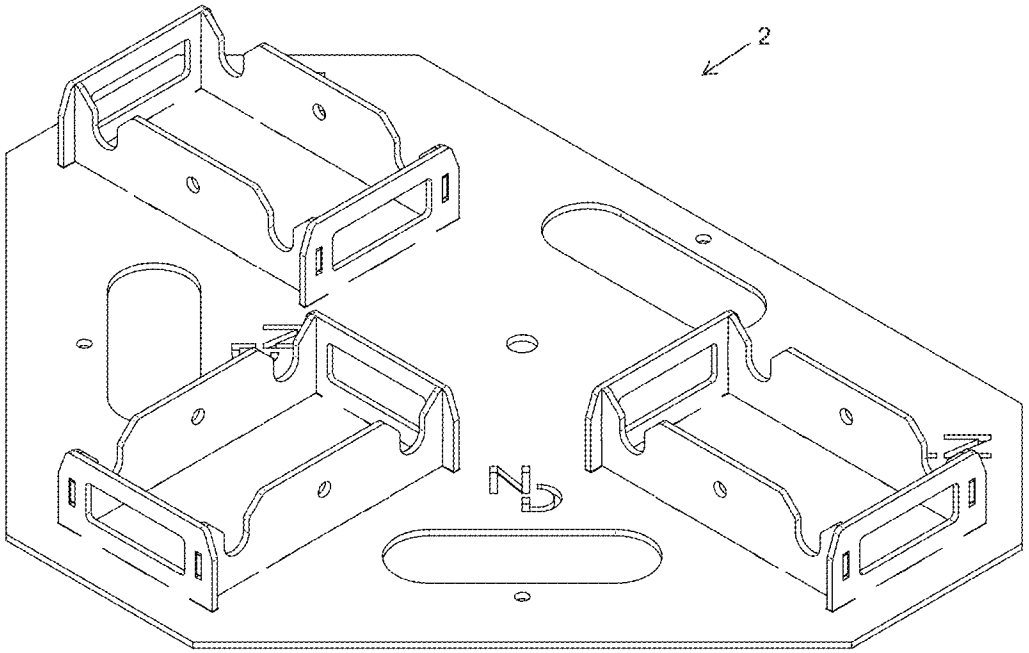
FIG. 52 is a perspective view of a T-shaped panel interlocking connector.
Figure 53:
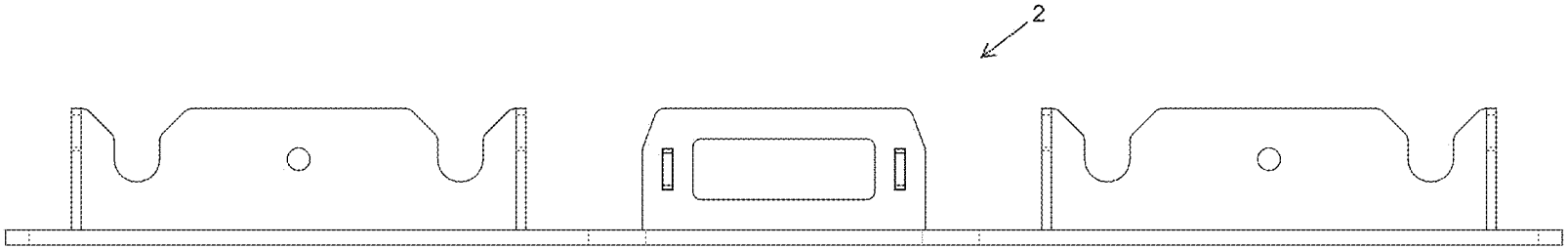
FIG. 53 is a side view of the T-shaped panel interlocking connector.
Figure 54:
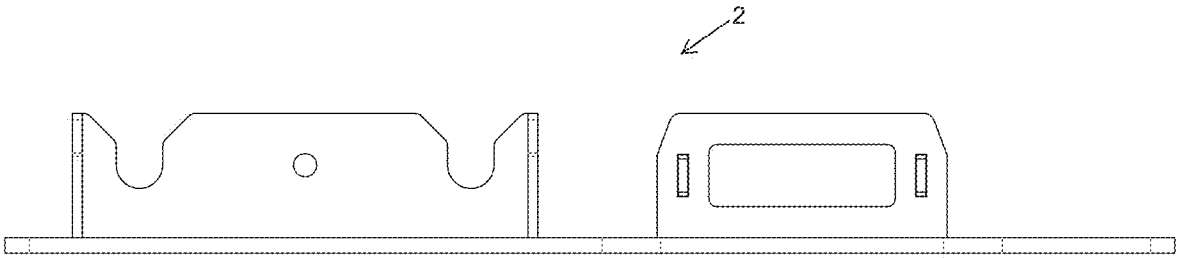
FIG. 54 is a front view of the T-shaped panel interlocking connector.
Figure 55:
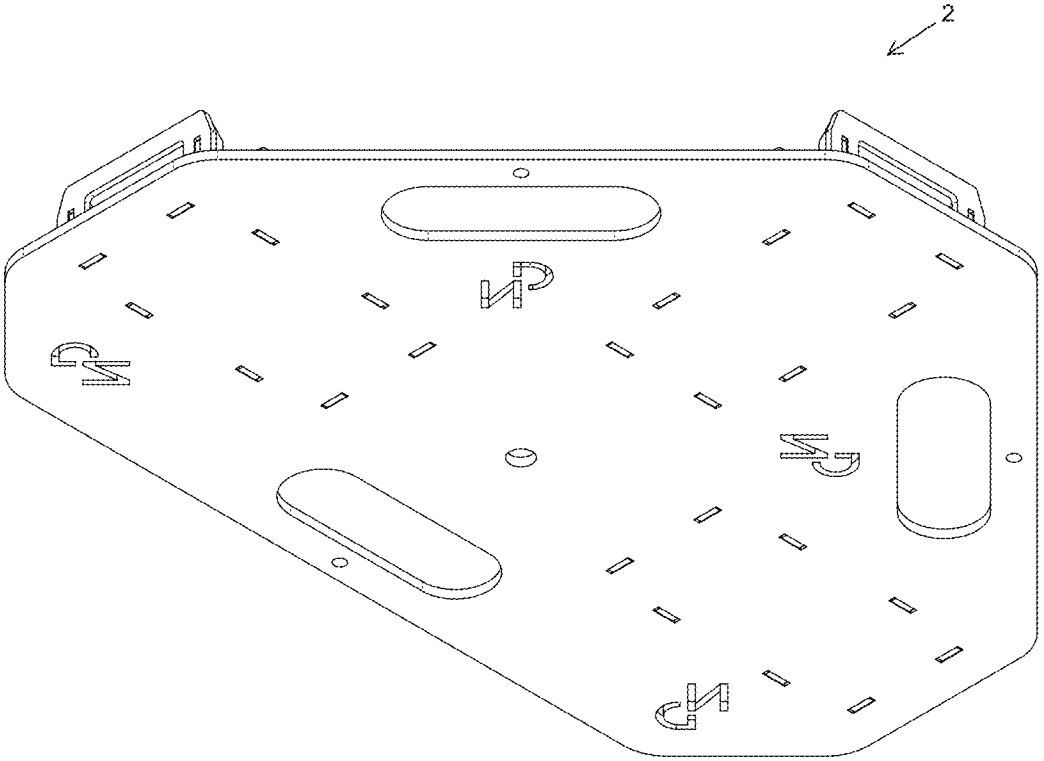
FIG. 55 is a perspective view of the T-shaped panel interlocking connector.
Figure 56:
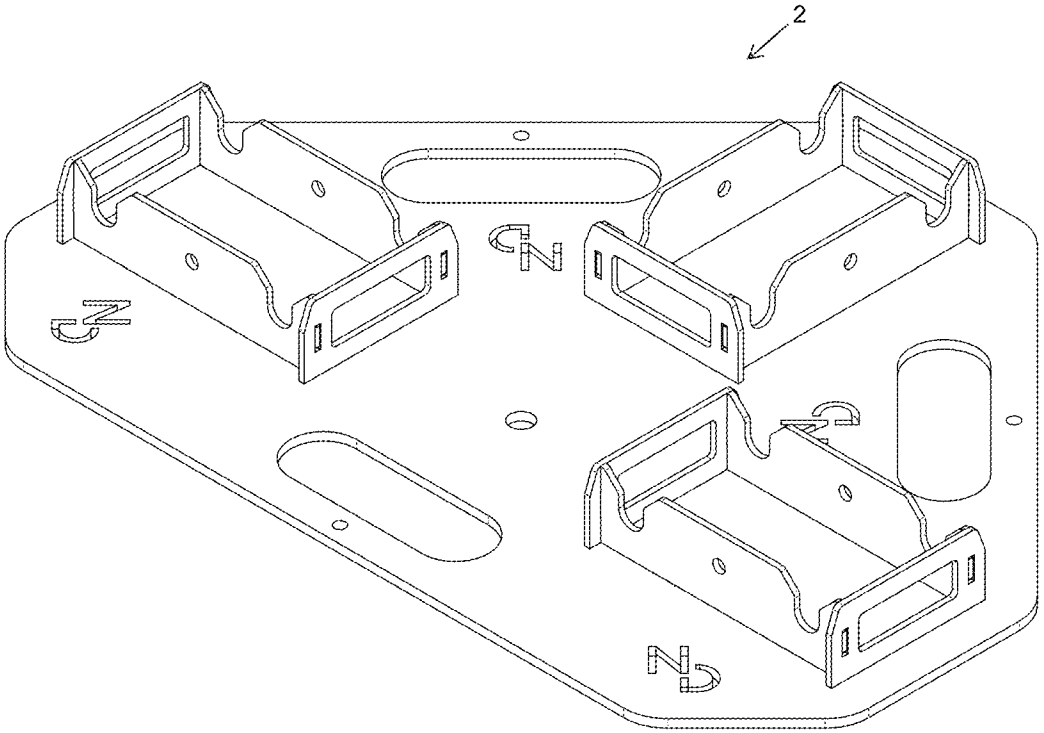
FIG. 56 is a perspective view of the T-shaped panel interlocking connector.
Figure 57:
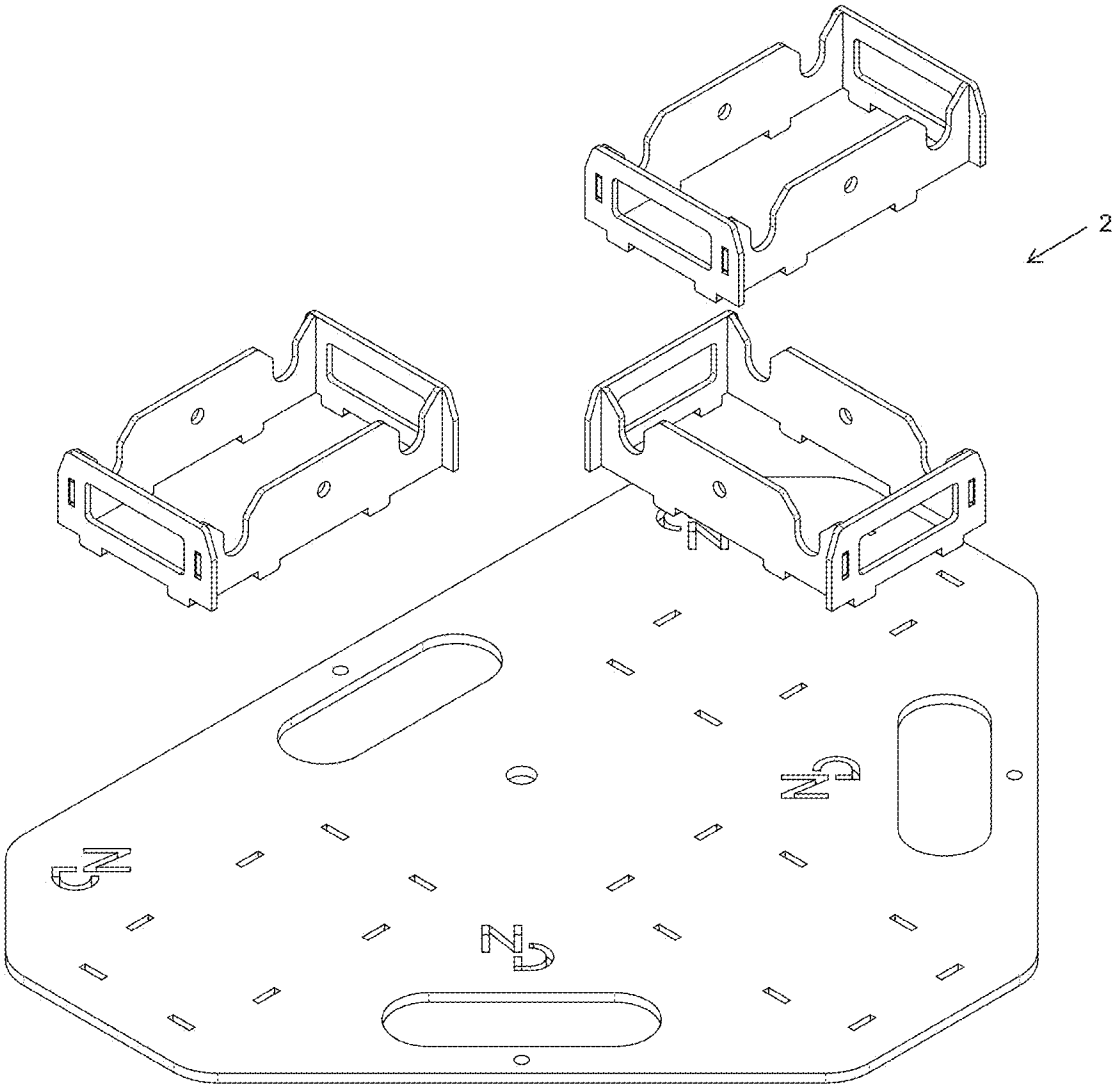
FIG. 57 is an exploded perspective view of the T-shaped panel interlocking connector.
Figure 58:
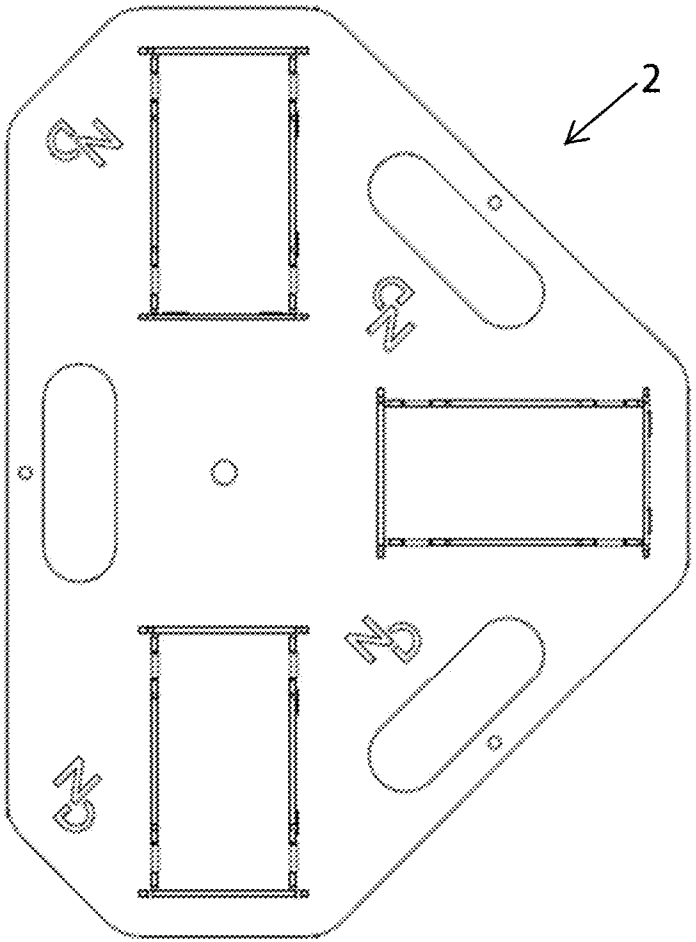
FIG. 58 is a plan view of the T-shaped panel interlocking connector.
Figure 59:
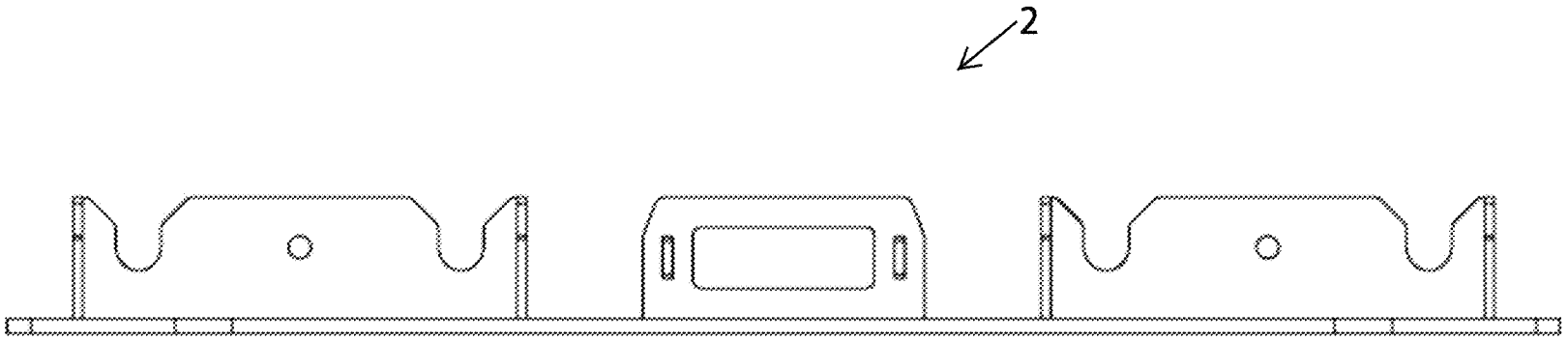
FIG. 59 is a side view of the T-shaped panel interlocking connector.

By way of example, as shown in FIG. 14, each wall panel 1 may have a horizontal sheet metal channel 8 at the top of the panel 1 defining the top channel 3 and a horizontal sheet metal channel 8 at the bottom of the panel 1 defining the bottom channel 4. The panel 1 may have vertical sheet metal channels 8 running along either side of the panel 1 between the sheet metal channel 8 at the top of the panel and the sheet metal channel 8 at the bottom of the panel 1, forming a rectangle. Additional vertical sheet metal channels 8 may similarly run between the sheet metal channels 8 at the top and bottom of the panel 1, reinforcing the structure. The additional vertical sheet metal channels 8 may run parallel to and be spaced apart from each other vertical sheet metal channel 8. The sheet metal channels 8 defining the rectangle may be solid, while the additional vertical sheet metal channels 8 reinforcing the structure may have one or more slots therein, thus lightening the weight of the panel 1. Alternately, the sheet metal channels 8 may have any desired configuration or the structure of the wall panels 1 may be made of any other desired components, so long as some part of those components define the top channel 3 and the bottom channel 4, housing wall pins 5. The sheet metal skins 9 may be generally flat and rectangular and may be attached to the sheet metal channels 8 by any desired attachment devices, such as bolts, rivets, screws, welding, adhesive, etc.

Each wall panel 1 may have one or more handle structures 11. Each handle structure 11 may be located between the sheet metal skins 9 and may be accessible through openings 12 in the sheet metal skins 9. Each handle structure 11 may comprise a rectangular housing with a handle component extending horizontally across the housing on each side of the handle structure 11, providing a handle on both the front and the back of the wall panel 1. The standard wall panel 1 may have two handle structures 11, providing four total handles on the wall panel 1, with two handles on each side. This may allow one person to easily maneuver the panel 1. Alternately to the handle structures 11 as shown, the wall panels 1 may have one or more alternate handle structures of any desired shape, configuration, quantity, and location.

In the wall panel 1 with a widow 6, as shown in FIGS. 19 through 23, the additional vertical sheet metal channels 8 may run only partway up the wall panel 1, allowing room for a window opening, which may be edged in additional sheet metal channels 8. The sheet metal skins 9 may have corresponding openings 13 for the window 6, which may be edged with frames 14. A single handle structure 11 may be included in the wall panel 1.

In the wall panel 1 with a door 7, as shown in FIGS. 24 through 28, the sheet metal channels 8 may define a door frame into which the door 7 may be secured via hinges 15. The sheet metal skins 9 may have a generally inverted U-shape, essentially edging the door along the top and sides. A threshold piece 16 may be located at the bottom of the panel 1, directly below the door 7 when the door 7 is closed. Instead of a single bottom channel 4 running horizontally along the bottom of the panel 1, the bottom channel 4 may be defined by two sheet metal channels 8 located at the bottom of the panel 1, one on either side of the threshold piece 16.

Two or more wall panels 1 may be temporarily secured to each other via a pair of panel interlocking connectors 2. Each panel interlocking connector 2 may be constructed of sheet metal plates welded together. Alternately, the panel interlocking connectors 2 may be made of any other desired material or materials and/or may be constructed via any other attachment devices or techniques. Each panel interlocking connector 2 may comprise a plate 17 and one or more saddle assemblies 18. The plate 17 may be generally flat. The saddle assemblies 18 may extend perpendicularly from the plate 17 on one side, with the other side flat. To connect two or more wall panels 1, one panel interlocking connector 2 may be used to connect the bottoms of the wall panels 1, with the flat side of the panel interlocking connector 2 resting on the floor, and another panel interlocking connector 2 may be used to connect the tops of the wall panels 1, with the flat side of the panel interlocking connector 2 facing upward.

Each of the saddle assemblies 18 may comprise two parallel side pieces 19 and two parallel end pieces 20, where the end pieces 20 are perpendicular to and interlock with the side pieces 19 to form a rectangular shape. The side pieces 19 may be spaced apart and the end pieces 20 may be correspondingly sized such that the saddle assembly 18 fits within the channels 3 and 4 of the wall panels 1. Each of the side pieces 19 may have a pair of slots 21, which may have the same spacing as the wall pins 5. For example, if the wall pins 5 are spaced at four inch increments, the centers of the slots 21 on each side piece 19 may likewise be spaced four inches apart. The slots 21 may be sized and shaped such that the wall pins 5 are receivable within the slots 21. Thus, each saddle assembly 18 may be inserted into a channel 3 or 4 of a wall panel 1, such that the wall pins 5 are located within the slots 21 and the plate 17 is touching either the top or bottom of the wall panel 1, depending on whether the saddle assembly 18 is inserted into top channel 3 or bottom channel 4 of the wall panel 1.

Each of the side pieces 19 may have a hole 22, which may be centered between the slots 21, as shown, or otherwise located as desired. The sides of channels 3 and 4 and the skins 9 of the wall panel 1 may have corresponding holes 23, such that holes 22 align with holes 23 when the saddle assembly 18 is fully inserted into a channel 3 or 4 with the wall pins 5 seated within the slots 21. A quick release pin 24 or other attachment device may be receivable in the holes 22 and 23. The pin 24 may be of sufficient length to extend from one side of the wall panel 1, through the saddle assembly 18, and out the other side of the wall panel 1. The pins 24 may securely hold the wall panels 1 and panel interlocking connectors 2 together, but may be easily removable for disassembly of the modular wall system.

The plate 17 of the panel interlocking connector 2 may have one or more openings 25, which may function as handles during setup and teardown. The plate 17 may additionally or alternately have one or more holes 28 for use in mounting accessories, such as speakers, cameras, fans, etc. These holes 28 may also be used for anchoring the modular wall system to the ground or other surface, including but not limited to concrete, asphalt, dirt, etc. This may allow the modular wall system to be used as semi-permanent wall structure.

Each of the pieces of the saddle assembly 18 may have one or more tabs 26 which may be receivable in one or more slots 27 in the plate 17. This may aid in construction of the panel interlocking connector 2. The tabs 26 and slots 27 may be seen in the exploded views of the panel interlocking connectors 2.

The panel interlocking connectors 2 may have any desired shape and configuration. In particular, multiple configurations of panel interlocking connectors 2 may be included in the modular wall system, allowing multiple configurations of wall panels 1. For any given variety of panel interlocking connector 2, the shape of the plate 17 may be dependent on the number and configuration of saddle assemblies 18 included thereon.

The modular wall system may include multiple varieties of panel interlocking connectors 2. For example, one variety of panel interlocking connector 2 may be a straight panel interlocking connector 2, as shown in FIGS. 29 through 36. Another variety of panel interlocking connector 2 may be a cross-shaped panel interlocking connector 2, as shown in FIGS. 37 through 43. Another variety may be a corner panel interlocking connector 2, as shown in FIGS. 44 through 51. Yet another variety may be a T-shaped panel interlocking connector 2, as shown in FIGS. 52 through 58. Other possible varieties of panel interlocking connectors 2 may include other numbers and/or configurations of saddle assemblies 18 or other features as desired. The modular wall system may include only one of these varieties, more than one of these varieties, or all of these varieties, each in any desired quantities.

The straight panel interlocking connector 2 may be used to join two wall panels 1 side by side to form a single, wider wall. The straight panel interlocking connector 2 may have two saddle assemblies 18. The two saddle assemblies 18 may be aligned along their long axes, but spaced apart such that one of the saddle assemblies 18 can receive the first two wall pins 5 of one wall panel 1 and the other saddle assembly 18 can receive the first two wall pins 5 of another wall panel 1, with the wall panels aligned and their sides abutting.

The cross-shaped panel interlocking connector 2 may be used to join four wall panels 1 to form a cross-shape. The cross-shaped panel interlocking connector 2 may have four saddle assemblies 18. Two saddle assemblies 18 may be aligned along their long axes and spaced apart, and the other two saddle assemblies 18 may likewise be aligned along their long axes and spaced apart, but perpendicular from the first two saddle assemblies 18. In other words, the four saddle assemblies 18 may each be equidistant from a central point at 90 degree angles from each other. The saddle assemblies 18 may be spaced such that each can receive the first two wall pins 5 of a wall panel 1, with the sides of the wall panels 1 abutting their adjacent wall panels along their corners, forming a square in the middle thereof. Alternately, four wall pins 5 from a single wall panel 1 may be received in two of the saddle assemblies 18, with the first two wall pins 5 of two additional wall panels 1 received in the other two saddle assemblies 18, with one side of each of the two additional wall panels 1 abutting either the front or the back of the single wall panel 1, sandwiching the wall panel 1 therebetween.

The corner panel interlocking connector 2 may be used to joint two wall panels 1 to form a corner. The corner panel interlocking connector 2 may have two saddle assemblies 18, which may lie perpendicular to each other and spaced apart such that one of the saddle assemblies 18 can receive the first two wall pins 5 of one wall panel 1 and the other saddle assembly 18 can receive the first two wall pins 5 of another wall panel 1, with the wall panels perpendicular to each other and one corner of the side of each abutting. Alternately, one of the saddle assemblies 18 can receive the first two wall pins 5 of one wall panel 1 and the other saddle assembly 18 can receive two wall pins 5 other than the first two wall pins 5 of another wall panel 1, allowing the wall panels to lie perpendicular to each other with the side of the first wall panel 1 abutting either the front or the back of the second wall panel 1.

The T-shaped panel interlocking connector 2 may be used to joint two or three wall panels 1 to form a T-shape. The T-shaped panel interlocking connector 2 may have three saddle assemblies 18, two of which may be aligned along their long axes, but spaced apart such that one of the saddle assemblies 18 can receive the first two wall pins 5 of one wall panel 1 and the other saddle assembly 18 can receive the first two wall pins 5 of another wall panel 1, with the wall panels aligned and their sides abutting. Alternately, both aligned saddle assemblies 18 may receive wall pins 5 of a single wall panel 1. Either way, the third saddle assembly 18 may lie perpendicular to the two aligned saddle assemblies 18 and may be spaced from the two aligned saddle assemblies 18 such that it may receive the first two wall pins 5 of an additional wall panel 1, the side of which may abut the front or back of the one or two wall panels 1 attached to the aligned saddle assemblies 18.

During use, the user may place two panel interlocking connectors 2 on the ground. The user may then vertically insert a wall panel 1 into the panel interlocking connectors 2 located on the ground. The user may insert a pin 24 into each of the aligned holes 22 and 23, securing the wall panel 1 to the panel interlocking connectors 2. The user may place additional panel interlocking connectors 2 on the ground, allowing placement of additional wall panels 1, as desired. The user may secure the additional wall panels and additional panel interlocking connectors 2 with additional pins 24 wherever there are aligned holes 22 and 23. Wherever two wall panels 1 come together, the user may place a panel interlocking connector 2 to the top channels 3 of the wall panels 1 and secure it into place with pins 24 where there are aligned holes 22 and 23, ensuring that the wall panels 1 are connected at both the top and the bottom. The panel interlocking connector 2 at the top of the panels 1 may match the panel interlocking connector 2 at the bottom of the panels 1. These steps may be repeated as many times as required to obtain the desired wall system configuration. All components of the modular wall system may be installed by hand without the use of tools.

The components of the modular wall system may be configured to represent a walled or otherwise confined space. As such, the assembled modular wall system may be used to simulate a variety of environments, such as an apartment, an office building, a house, a jet bridge, or any other walled area. The system may be used in any open space, such as a building, vehicle, container, outdoor area, or other open space.

After use or when a different configuration is desired, the modular wall system may be disassembled by removing the pins 24, removing the panel interlocking connectors 2 from the tops of the wall panels 1, and removing the wall panels 1 from the panel interlocking connectors 2 on the ground. As with assembly, all components of the modular wall system may be disassembled by hand without the use of tools.

The components of the modular wall system may be any desired size. For example, each wall panel 1 may be 84 inches tall, 43.938 inches wide, and 4 inches deep and the pins 5 may be spaced 4 inches apart. Each window 6 may be 30 inches wide and 30 inches tall. Each panel interlocking connector 2 may be 1.688 inches tall. The plate 17 of the straight panel interlocking connector 2 may be 15.250 inches by 9 inches; the plate 17 of the cross-shaped panel interlocking connector 2 may be 19.250 inches square; the plate 17 of the corner panel interlocking connector 2 may be 16.092 inches by 13.172 inches; and the plate 17 of the T-shaped panel interlocking connector may be 19.250 inches by 14.125 inches. Alternately, any or all of the foregoing may be any desired size, dimension, and/or ratio.

The modular wall system may additionally or alternately include miniature versions of the system components. These miniature components may allow the user to mock up a model of an existing walled or confined space and/or the walled or confined space built or planned to be built using the full-size components of the modular wall system. This may allow the user to plan what type and quantities of components are needed to build a desired configuration; to plan a training exercise; or to plan a tactical mission in a real-life space modeled by the miniature components. Each miniature component may be identical to a corresponding full-size component and may be assembled and disassembled the same way.

Whereas, the devices and methods have been described in relation to the drawings and claims, it should be understood that other and further modifications, apart from those shown or suggested herein, may be made within the spirit and scope of this invention.

What is claimed is:

1. A modular wall system comprising:

a plurality of wall panels each having a top channel; a bottom channel; and a plurality of wall pins, where each of the wall pins spans either the top channel or the bottom channel and where each of the wall pins in the top channel are equally spaced apart and each of the wall pins in the bottom channel are equally spaced apart, such that:

the wall pins in the top channel comprise at least a first top wall pin, a second top wall pin, and a third top wall pin, where the third top wall pin is equidistant from both the first top wall pin and the second top wall pin; and the wall pins in the bottom channel comprise at least a first bottom wall pin, a second bottom wall pin, and a third bottom wall pin, where the third bottom wall pin is equidistant from both the first bottom wall pin and the second bottom wall pin;

a plurality of panel interlocking connectors capable of temporarily connecting two or more wall panels; and a plurality of pins capable of temporarily securing the panel interlocking connectors to the wall panels, where the modular wall system is capable of being assembled and disassembled without the use of tools.

2. The modular wall system of claim 1 where each of the panel interlocking connectors comprises:

a plate; and one or more saddle assemblies, where each of the saddle assemblies is receivable within either the top channel or the bottom channel, each of the saddle assemblies comprising a pair of slots, where the wall pins are receivable within the slots.

3. The modular wall system of claim 1 where the wall panels and panel interlocking connectors are compatible with non-lethal training ammunition.

4. The modular wall system of claim 1 where the plurality of wall panels comprises:

one or more wall panel with a window therein;

one or more wall panel with a door therein;

one or more wall panel with no door and no window; or any combination thereof.

5. The modular wall system of claim 1 where each wall panel comprises:

a plurality of sheet metal channels; and two sheet metal skins.

6. The modular wall system of claim 1 where each wall panel comprises at least one handle structure.

7. The modular wall system of claim 1 where the plurality of panel interlocking connectors comprises:

one or more straight panel interlocking connector;

one or more cross-shaped panel interlocking connectors;

one or more corner panel interlocking connectors;

one or more T-shaped panel interlocking connectors; or any combination thereof.

8. The modular wall system of claim 7 where the straight panel interlocking connector is capable of joining two wall panels side-by-side.

9. The modular wall system of claim 7 where the cross-shaped panel interlocking connector is capable of joining three or four wall panels to form a cross shape.

10. The modular wall system of claim 7 where the corner panel interlocking connector is capable of joining two wall panels to form a corner.

11. The modular wall system of claim 7 where the T-shaped panel interlocking connector is capable of joining two or three wall panels to form a T-shape.

12. The modular wall system of claim 1 where:

the plurality of wall panels comprises a plurality of full-size wall panel and a plurality of miniature wall panels; and the plurality of panel interlocking connectors comprises a plurality of full-size panel interlocking connectors and a plurality of miniature panel interlocking connectors, such that the system is capable of being configured into both a full-size walled structure and a model of the full-size walled structure.

13. The modular wall system of claim 1 where the plurality of wall pins are spaced 4 inches apart from each other.

14. The modular wall system of claim 1 where:

the wall pins in the top channel comprise at least the first top wall pin, the second top wall pin, two opposing end top wall pins, and at least two intermediate top wall pins where the intermediate top wall pins are located between the second top wall pin and the two opposing end top wall pins;

the wall pins in the bottom channel comprise at least the first bottom wall pin, the second bottom wall pin, two opposing end bottom wall pins, and at least two intermediate bottom wall pins where the intermediate bottom wall pins are located between the second bottom wall pin and the two opposing end bottom wall pins; and at least one of the plurality of panel interlocking connectors is capable of joining a first wall panel and a second wall panel by receiving:

the first top wall pin and the second top wall pin of the first wall panel and two of the at least two intermediate top wall pins of the second wall panel; or the first bottom wall pin and the second bottom wall pin of the first wall panel and two of the at least two intermediate top wall pins of the second wall panel, such that the first wall panel and the second wall panel lie perpendicular to each other with a side of the first wall panel abutting either a front or a back of the second wall panel.

* * * * *